US011607621B2

(12) United States Patent
O'Brien et al.

(10) Patent No.: US 11,607,621 B2
(45) Date of Patent: Mar. 21, 2023

(54) TOY FIGURINE AND PACKAGING

(71) Applicant: Mattel, Inc., El Segundo, CA (US)

(72) Inventors: Kenna O'Brien, Redondo Beach, CA (US); Brian Hong, Valencia, CA (US); Kelley Lindberg, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 17/156,745

(22) Filed: Jan. 25, 2021

(65) Prior Publication Data

US 2021/0228994 A1 Jul. 29, 2021

Related U.S. Application Data

(60) Provisional application No. 62/964,941, filed on Jan. 23, 2020.

(51) Int. Cl.

| | |
|---|---|
| ***A63H 3/00*** | (2006.01) |
| ***A63H 9/00*** | (2006.01) |
| ***A63H 3/52*** | (2022.01) |
| ***A63H 3/46*** | (2006.01) |
| ***A63H 33/22*** | (2006.01) |
| *A63H 3/36* | (2006.01) |
| *A63H 3/44* | (2006.01) |

(52) U.S. Cl.

CPC ..... *A63H 3/52* (2013.01); *A63H 3/46* (2013.01); *A63H 9/00* (2013.01); *A63H 33/22* (2013.01); *A63H 3/365* (2013.01); *A63H 3/44* (2013.01)

(58) Field of Classification Search

CPC ... A63H 3/00; A63H 3/36; A63H 9/00; A63H 33/22

See application file for complete search history.

(56) References Cited

U.S. PATENT DOCUMENTS

| | | | |
|---|---|---|---|
| 1,730,177 | A | 10/1929 | Cleave |
| 2,952,462 | A | 9/1960 | Planin |
| 3,022,558 | A | 2/1962 | Kinley |
| 3,915,296 | A | 10/1975 | Spencer |

(Continued)

FOREIGN PATENT DOCUMENTS

| | | | |
|---|---|---|---|
| WO | 1999062366 | A2 | 12/1999 |
| WO | 1999062366 | A3 | 3/2000 |

(Continued)

OTHER PUBLICATIONS https://www.youtube.com/watch?v=I7NIneqmIVQ, LOL Surprise Series 4 Lil Sisters Color Changes First Look | L.O.L. Decoder Lil Sis Real Dolls, May 24, 2018.

*Primary Examiner* — John A Ricci

(74) *Attorney, Agent, or Firm* — Edell, Shapiro & Finnan, LLC

(57) ABSTRACT

A toy figurine and/or toy figurine packaging is coated with a dissolvable layer. When the toy figurine is coated, the toy figurine is entirely coated so that its overall appearance, including its skin complexion and/or facial features, is substantially hidden or obscured. Then, when the figurine is submerged in a fluid, the dissolvable layer dissolves to reveal the figurine's appearance that had been hidden underneath the dissolvable layer. When the toy figurine packaging is coated, the toy figurine packaging hides the identity of a toy figurine enclosed therein until fluid is introduced to the packaging.

20 Claims, 17 Drawing Sheets

(56) References Cited

U.S. PATENT DOCUMENTS

| | | | | |
|---|---|---|---|---|
| 4,212,393 | A | 7/1980 | Lenkoff | |
| 4,257,188 | A | 3/1981 | Barker | |
| 4,529,569 | A | 7/1985 | Palau | |
| 4,738,647 | A | 4/1988 | Renger | |
| 4,881,915 | A | 11/1989 | Liaw | |
| 5,032,102 | A | 7/1991 | Davidson | |
| 5,037,302 | A | 8/1991 | Sirota | |
| 5,133,683 | A | 7/1992 | Dorfman | |
| 5,236,384 | A | 8/1993 | Fabricant | |
| 5,273,476 | A | 12/1993 | Dorfman | |
| 5,364,470 | A | 11/1994 | Greenberg | |
| 5,404,731 | A | 4/1995 | Traub | |
| 5,447,584 | A | 9/1995 | Shakespeare | |
| 5,494,472 | A | 2/1996 | Levy | |
| 5,639,245 | A * | 6/1997 | McMains | G09B 19/00 446/87 |
| 5,813,895 | A | 9/1998 | Cho | |
| 5,842,905 | A | 12/1998 | Lee | |
| 5,860,194 | A | 1/1999 | Takizawa | |
| 5,897,418 | A * | 4/1999 | Spector | A63H 3/06 446/268 |
| 5,930,876 | A | 8/1999 | Takizawa | |
| 5,947,788 | A * | 9/1999 | Derrah | A63H 23/10 446/154 |
| 6,000,168 | A | 12/1999 | Demusz | |
| 6,092,658 | A * | 7/2000 | Pietrafesa | B65D 81/365 446/72 |
| 6,409,569 | B1 | 6/2002 | Boone | |
| 6,416,853 | B1 | 7/2002 | Nakashima | |
| 6,455,478 | B1 | 9/2002 | Bitton | |
| 6,558,221 | B1 | 5/2003 | Yang | |
| 6,585,555 | B2 | 7/2003 | Wong | |
| 6,720,296 | B1 | 4/2004 | Bitton | |
| 6,736,692 | B1 | 5/2004 | Hoyos Zermeno | |
| 6,905,431 | B2 | 6/2005 | Pearce | |
| 7,189,133 | B2 | 3/2007 | Harata | |
| 7,757,773 | B2 | 7/2010 | Rytlewski | |
| 8,233,099 | B1 | 7/2012 | Comarow | |
| 8,394,750 | B1 | 3/2013 | Forgash | |
| 8,444,450 | B2 | 5/2013 | Shibahashi | |
| 8,708,767 | B2 | 4/2014 | Heller | |
| 8,815,318 | B2 | 8/2014 | Zoss | |
| 9,931,579 | B1 | 4/2018 | Garcia et al. | |
| 10,179,673 | B2 | 1/2019 | Garcia et al. | |
| 2002/0150737 | A1 | 10/2002 | Nakashima | |
| 2003/0087580 | A1 | 5/2003 | Shibahashi | |
| 2003/0194941 | A1 | 10/2003 | Janning | |
| 2006/0019574 | A1 | 1/2006 | Solomita | |
| 2006/0285773 | A1 | 12/2006 | Shaffer | |
| 2007/0015437 | A1 | 1/2007 | Laurienzo | |
| 2007/0149091 | A1 | 6/2007 | Viohl | |
| 2007/0173170 | A1 | 7/2007 | Wu | |
| 2009/0095766 | A1 | 4/2009 | Trainello | |
| 2010/0147731 | A1 | 6/2010 | Miler | |
| 2014/0162526 | A1 | 6/2014 | Duda, III | |
| 2017/0295839 | A1 | 10/2017 | Gass | |
| 2018/0002084 | A1 | 1/2018 | Keuleers | |
| 2018/0264370 | A1 | 9/2018 | Consorti | |

FOREIGN PATENT DOCUMENTS

| | | | |
|---|---|---|---|
| WO | 2000077463 | A1 | 12/2000 |
| WO | 2017108110 | A1 | 6/2017 |

* cited by examiner

TOY FIGURINE AND PACKAGING

CROSS REFERENCE TO RELATED APPLICATIONS

This application claims priority to and is based on U.S. Patent Application No. 62/964,941, filed Jan. 23, 2020, entitled "Toy Figurine and Packaging," the entire disclosure of which is incorporated herein by reference.

FIELD OF THE INVENTION

The present application relates generally to toy dolls and/or figurines and, in particular, to toy dolls/figurines and/or packaging for toy dolls/figurines that can reveal an appearance of a toy doll/figurine.

BACKGROUND

Through the years, toy dolls and/or figurines (for simplicity, referred to herein as figurines or toy figurines) have provided amusement and entertainment for children. That is, toy dolls and figurines have some inherent play value. To increase this play value, various features, such as action or movement features, have been incorporated into some figurines (e.g., so that figurines can appear to walk, crawl, talk, etc.).

Additionally or alternatively, some figurines allow a user to modify the appearance of the figurine. For example, a toy figurine might include thermochromic hair, layered clothing, features that move to "transform" the doll (e.g., from a mermaid to a princess), or other such appearance changing features. As one example of a figurine with appearance changing features, U.S. Pat. No. 5,032,102, which is issued to Davidson et al. and entitled TOY FIGURE HAVING WATER DISSOLVABLE CLOTHES AND FACIAL ELEMENTS, discloses a doll with a combination of waterproof materials and overlying fabric layers or facial appearance elements formed of a water dissolvable fabric or water dissolvable material, respectively. Thus, when the doll is immersed in water, the dissolvable fabric layers and dissolvable facial appearance elements are dissolved and expose the underlying waterproof elements.

Despite the foregoing, there is a continuing need for ever more interesting and varied doll features, for example, to surprise or entertain a child. In particular, while the features of U.S. Pat. No. 5,032,102 may be interesting and engage a user, the features may provide a limited amount of surprise or suspense for the user, as the user can typically see the doll's overall appearance before or during exposure of the underlying waterproof elements.

SUMMARY

A toy figurine and a toy set including a toy figurine are presented herein. In at least some embodiments, the toy figurine is coated with a dissolvable layer. More specifically, the toy figurine is entirely coated so that its overall appearance, including its skin complexion and facial features, is substantially hidden or obscured. Then, when the figurine is submerged in a fluid, the dissolvable layer dissolves to reveal the figurine's appearance that had been hidden underneath the dissolvable layer. Additionally or alternatively, packaging for the toy figurine may be coated with the dissolvable layer so that when a fluid is poured onto or into the packaging, an overall appearance of the figurine is revealed. Thus, the toy figurine and/or the packaging presented herein may provide a surprise for the user, adding to the play value of the toy figurine.

Other systems, methods, features and advantages will be, or will become, apparent to one with skill in the art upon examination of the following figures and detailed description. All such additional systems, methods, features and advantages are included within this description, are within the scope of the claimed subject matter.

BRIEF DESCRIPTION OF THE DRAWINGS

The toy figurine and packaging presented herein may be better understood with reference to the following drawings and description. The elements in the figures are not necessarily to scale, emphasis instead being placed upon illustrating the principles of the toy figurine. In the figures, like-referenced numerals designate corresponding parts throughout the different views.

DETAILED DESCRIPTION

The toy figurine and/or the toy packaging presented herein includes a dissolvable layer. For example, in at least some embodiments, a toy figurine is entirely coated with a dissolvable layer so that its overall appearance is substantially hidden or obscured. When a figurine body underlying the dissolvable layer is obscured, at least the skin complexion and/or facial features of the underlying figurine body may be hidden or obscured. Consequently, a user may not be able to identify the toy figurine as a particular character from a set of characters when the underlying figurine body is covered with the dissolvable layer. When the figurine is submerged in a fluid, the dissolvable layer dissolves to reveal the figurine's appearance (e.g., at least the skin complexion and/or facial features) that had been hidden underneath the dissolvable layer. Additionally or alternatively, packaging for the toy figurine may include the dissolvable layer so that the identity of the figurine, features of the toy figurine (e.g., its skin complexion, facial features, etc.) are obscured or hidden. Thus, the toy figurine and/or the toy figurine packaging presented herein may provide a surprise for the user, adding to the play value of the toy figurine.

Figure 1:
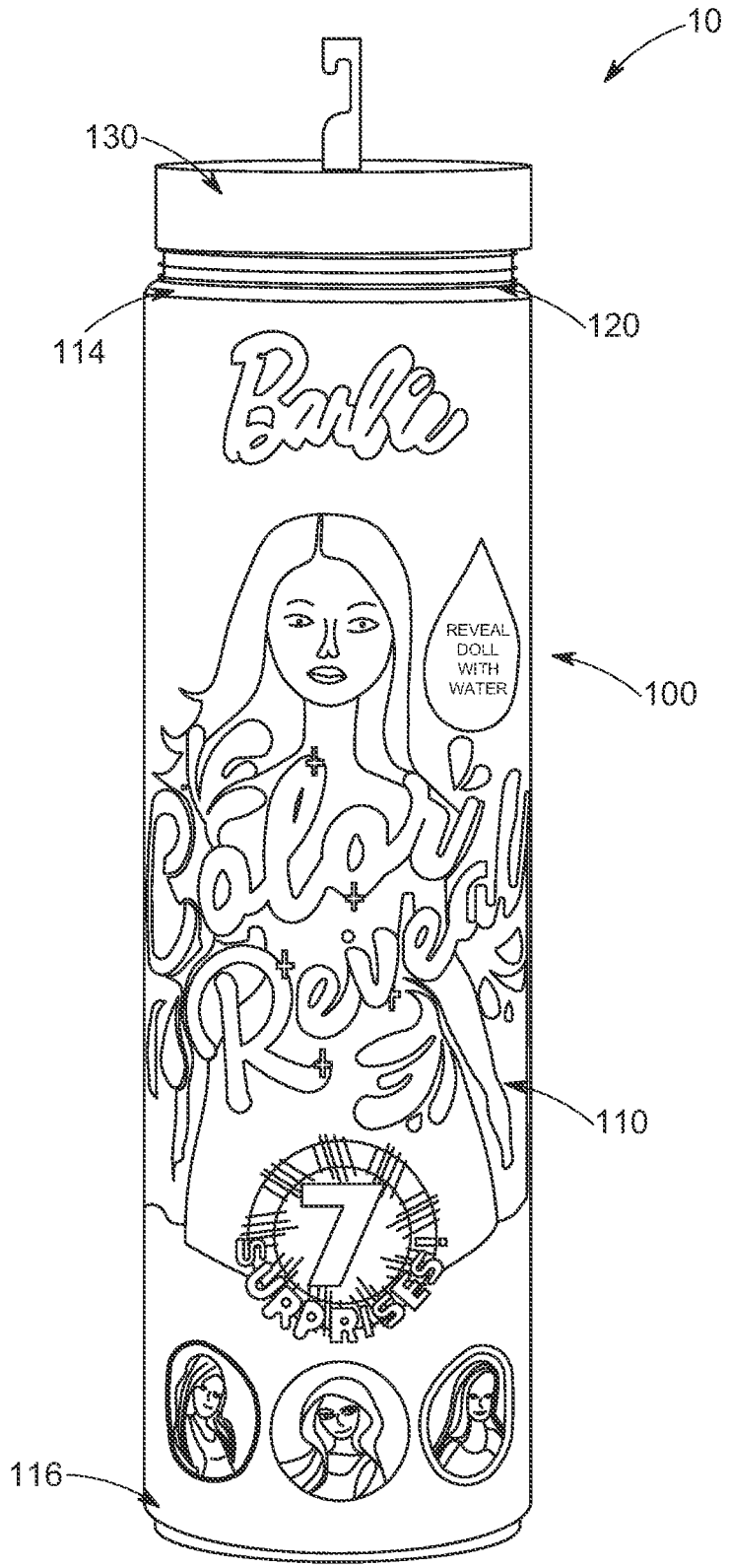
FIG. 1 is a front view of an example embodiment of a toy set including an example embodiment of the toy figurine with a dissolvable layer presented herein.
Figure 2:
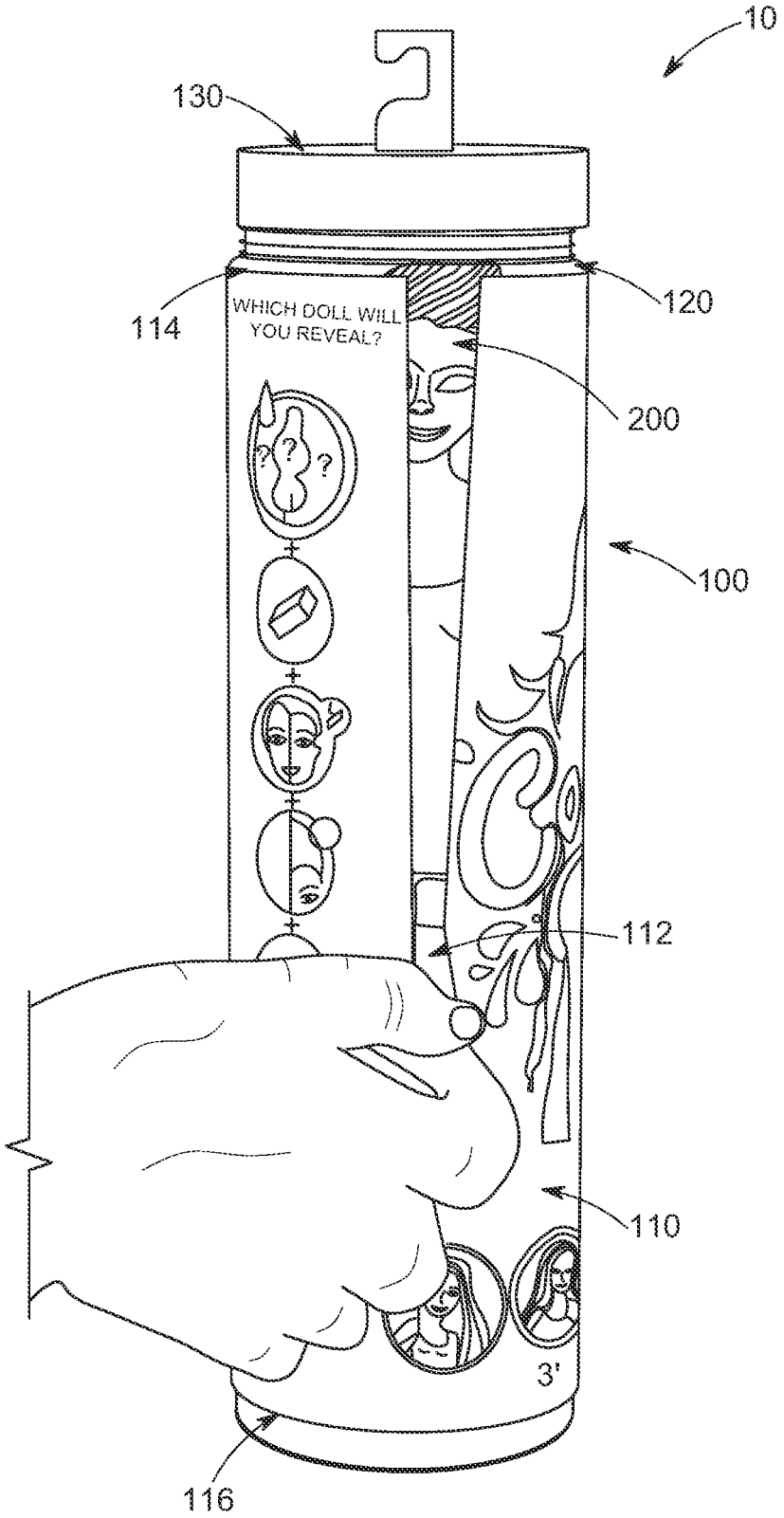
FIG. 2 is a front view of the toy set of FIG. 1 while packaging included in the toy set is being opened.

FIGS. 1 and 2 depict a toy set 10 that includes an example embodiment of a toy figurine with a dissolvable layer. The toy set 10 includes packaging 100 with a vessel 120 within which toy figurine 200 may be packaged, perhaps together with accessories 260. Generally, the vessel 120 is sized to receive a fluid (e.g., fluid F1 as shown in FIGS. 6-9) within which the figurine 200 may be submerged to remove a dissolvable layer 250 (see, for example, FIGS. 3 and 4) of the figurine 200. In the depicted embodiment, the vessel 120 is a transparent, cylindrical, open-top vessel 120 defined by a sidewall 122 and bottom 124. The bottom 124 closes a first end of the sidewall 122 and an opposite end of the sidewall 122 defines an open top 128. Thus, the bottom 124 and sidewall 122 collectively define a compartment "C" that can receive a fluid within which the toy figurine can be submerged. The compartment C may define a fixed volume that is specifically sized to allow a dissolvable layer to be removed from a figurine and to obscure the figurine as the dissolvable layer is removed.

Moreover, in the depicted embodiment, the entire vessel 120 is transparent (e.g., so that a user can watch a removal of the dissolvable layer 250 occurring within the vessel 120). However, in other embodiments, the vessel 120 may be any size or shape and one or more portions of the vessel 120 may be transparent while one or more other portions are opaque, reflective, etc. Additionally, as mentioned, in some embodiments, at least a portion of the vessel 120 may be covered (e.g., coated) with a dissolvable layer, either instead of or in addition to the dissolvable layer 250 included on the toy figurine 200. An example of packaging with a dissolvable layer is described below in connection with FIGS. 15-23.

In the depicted embodiment, the packaging 100 also includes outer packaging 110 and a lid 130. The outer packaging 110 may be opaque and may substantially cover the sidewall 122 of the vessel 120 so that the toy figurine 200 is hidden from view at a point of sale location, insofar as, in this instance, the term "substantially" is intended to denote coverage of more than 80%, 85%, 90%, 95%, or any other percentage between 70-100% of the sidewall 122. That is, the outer packaging 110 may be an annular element that extends from a top edge 114 adjacent or proximate the open top 128 of the vessel 120 to a bottom edge 116 adjacent or proximate the bottom 124 of the vessel 120. As can be seen in FIG. 2, the outer packaging 110 may also include a removal element 112, such as a tear strip and/or a perforation that allows for easy removal of the outer packaging 110. Once the outer packaging 110 is removed from the vessel 120, a user may be able to view the dissolvable layer 250 of the toy figurine 200 (as shown in FIG. 2). Thus, outer packaging 110 may create a first surprise element for the user that reveals the figurine 200 without revealing the entire or overall appearance of the toy figurine 200 (as is explained in further detail below).

Figure 3:
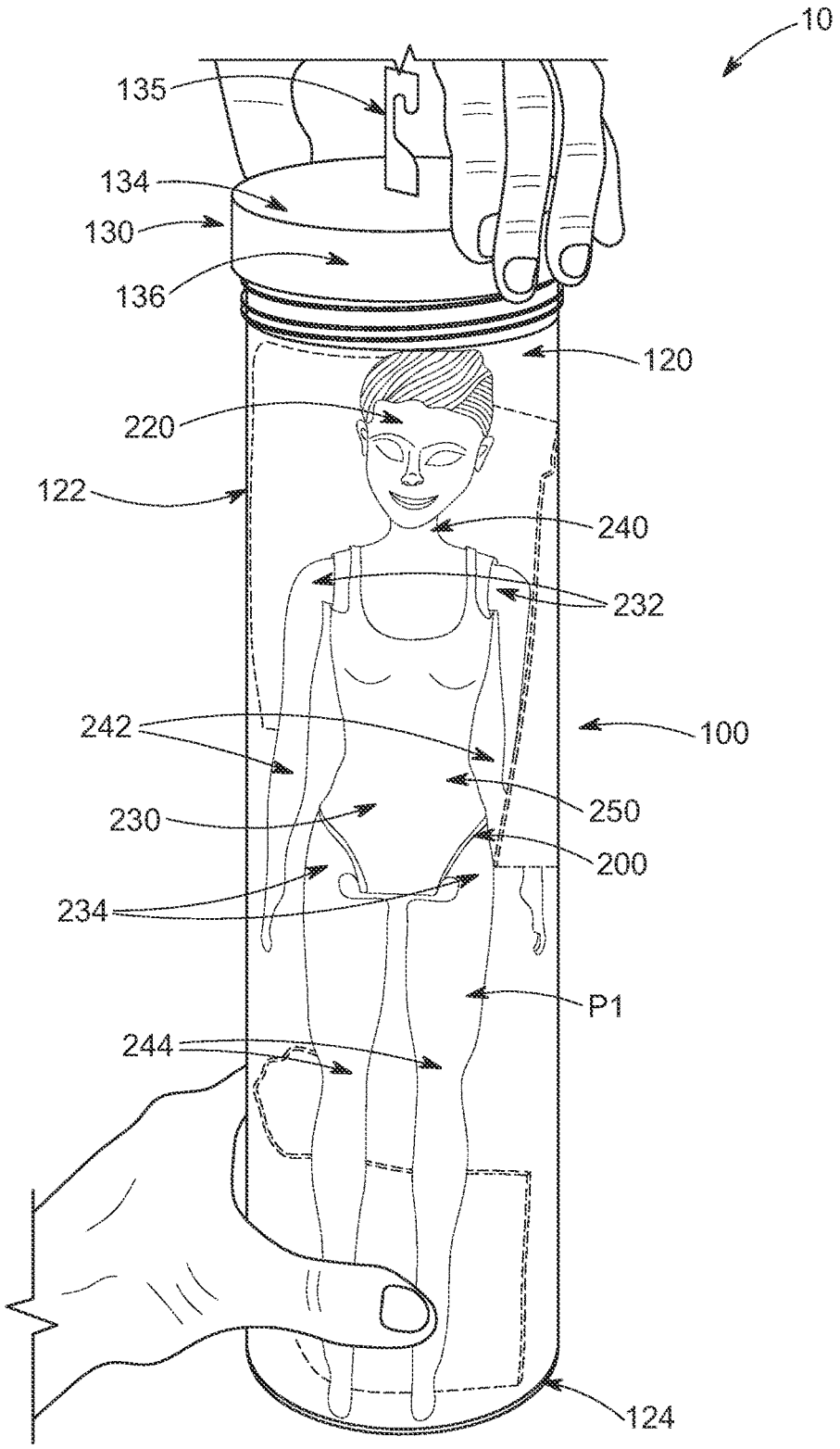
FIG. 3 is a front view of the toy set of FIG. 1 with an outer casing removed so that the toy figurine is visible through the packaging.
Figure 4:
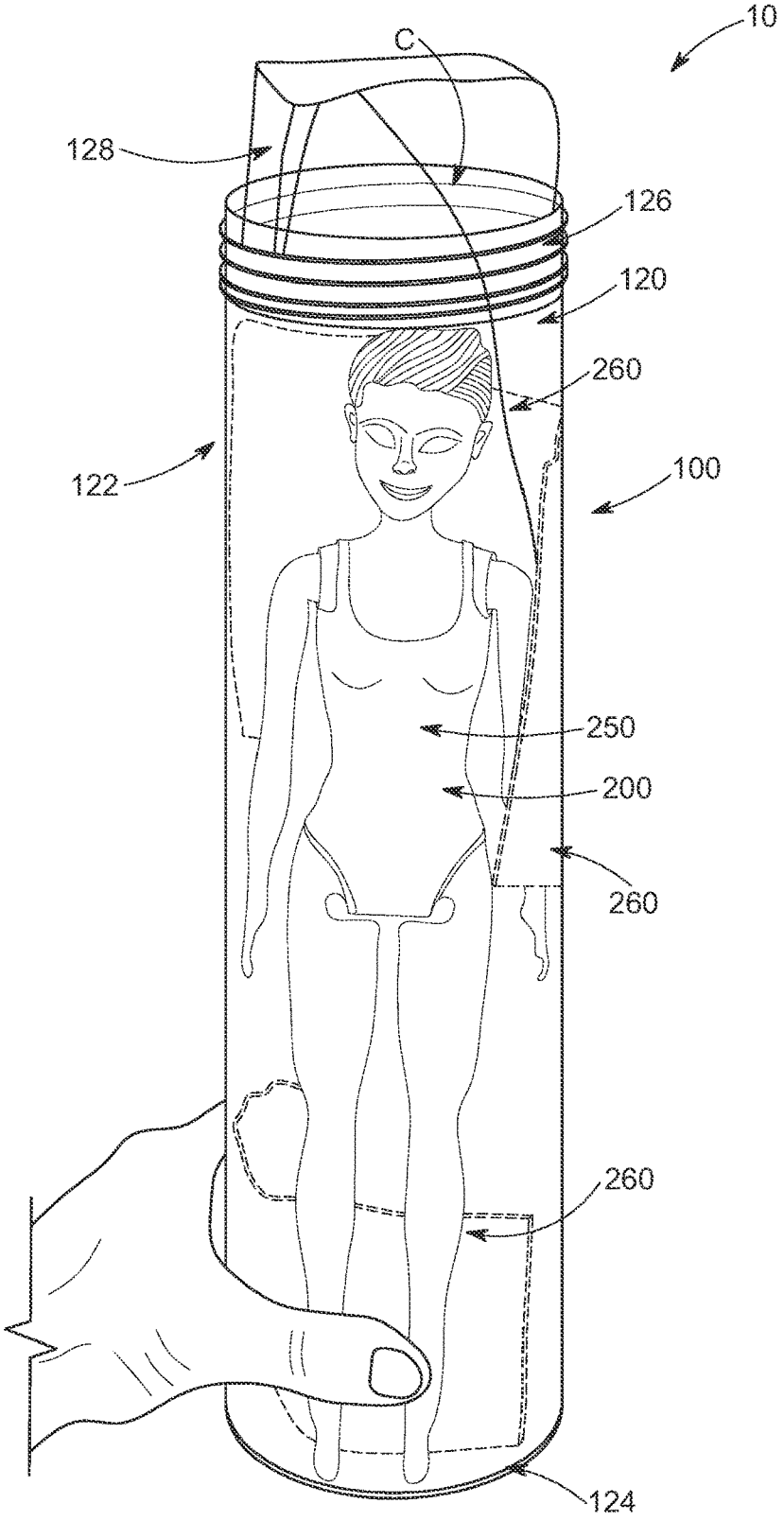
FIG. 4 is a front view of the packaging of FIG. 1 with the outer casing and a top lid removed.

Still referring to FIGS. 1 and 2, but now with reference to FIGS. 3 and 4 as well, the lid 130 may removably close the vessel 120. In the depicted embodiment, this removable closure is achieved with threading. In particular, the lid includes a sidewall 136 with internal threading (not shown) configured to engage and mate with threads 126 included on the vessel 120 adjacent the open top 128 (see FIG. 4). Once the lid 130 is threaded onto the vessel 120, a bottom surface of the lid 130 (not shown) may, in at least some embodiments, seal the compartment C to provide a watertight enclosure. Thus, in at least some embodiments, the figurine 200 might be sealed in a fluid-filled compartment C and the entire vessel 120 can be shook or otherwise agitated to cause removal of the dissolvable layer 250 of the figurine. Sealing the compartment C may form a fixed volume, for example, in the range of approximately 1.5 Liters to approximately 2 Liters.

In the depicted embodiment, a top surface 134 of the lid 130 also includes a hook 135 that allows the toy set 10 to be stored or display on a rod. However, in other embodiments, the lid 130, vessel 120, or outer packaging 110 may also include other elements that facilitate storage and/or display in any desirable manner. Similarly, in various embodiments, any portion of packaging 100 may incorporate unshown elements like doll stands, play accessories, and the like, in any desirable manner (e.g., the top surface 134 or the bottom surface of lid 130 may include or define a doll stand).

In FIG. 3, the outer packaging 110 has been removed and, thus, the toy figurine 200 is visible from an exterior of the vessel 120. However, since the dissolvable layer 250 entirely covers the figurine 200, the underlying body 210 (see FIG. 10) and overall appearance of the figurine 200 may still be hidden from the user. More specifically, the dissolvable layer 250 may hide or obscure at least the skin complexion 212 (see FIG. 10), facial features 222 (see FIG. 10), and/or clothing 236 (see FIG. 10) of the figurine 20, while showing the overall shape/features of the figurine. Thus, when the dissolvable layer 250 is disposed on the toy figurine 200, a user (e.g., a child) may be unable to determine which character (e.g., from a set of characters) they have in their possession. That is, the dissolvable layer 250 may allow a user to discern that the toy is a toy figurine, but may hide the identity of the figurine 20.

That said, when the toy figurine 200 is disposed within the packaging 100, the toy figurine 200 may be in a first position P1. In at least some embodiments, the toy figurine 200 may be covered (e.g., sprayed, painted, or otherwise coated) with the dissolvable layer 250 while in position P1 and, thus, the underlying body 210 (see FIG. 10) may be entirely covered when in position P1 but may be slightly visible if the toy figurine is moved out of position P1 (e.g., when the figurine is posed). Thus, for the purposes of this application, the term "entirely covered" may mean that the toy figurine is covered with a dissolvable layer 250 so that the underlying body 210 is hidden from view at least when the toy figurine is disposed in the position in which it is coated, sold, and/or packaged (e.g., position P1).

As a specific example, in the depicted embodiment, the toy figurine 200 includes head 220 that is movably mounted on a neck 240, arms 242 that are movably mounted to a torso 230 at shoulder joints 232 (e.g., ball joints), and legs 244 that are movably mounted to torso 230 at hip joints 234 (e.g., ball joints). In position P1, the head 220 is looking straight ahead, both arms 242 are straight down at the sides of the figurine 200, and both legs 244 are positioned straight down. With these movable parts in these positions, none of the underlying body 210 is visible. That is, with these movable parts in these positions, the dissolvable layer 250 covers or hides the entire underlying body 210. However, if the figurine 200 were removed from the packaging 100 and one of the movable portions of the figurine 200 were moved/posed (e.g., if an arm 242 were raised above the head 220), the underlying body 210 may become slightly visible at the joint facilitating the movement (e.g., at the shoulder 232 for movement of arm 242). Nevertheless, as mentioned above, the depicted embodiment may be referred to as being entirely covered by the dissolvable layer 250.

Importantly, since the dissolvable layer 250 entirely covers the underlying body 210, facial features 222 (see FIG. 10), such as hair 224 (see FIG. 10), eyes 225 (see FIG. 10), and lips 226 (see FIG. 10) are obscured or hidden from view. Notably, in the depicted embodiment, to hide the hair 224 under the dissolvable layer 250, the hair 224 is short and sculpted from plastic, but, in other embodiments, longer strands of hair 224 might be included on the figurine 200 and coated with the dissolvable layer 250. Additionally or alternatively, the skin complexion 212 (see FIG. 10) of the figurine 200 and/or clothing 236 (see FIG. 10) included on the torso 230 of the underlying body 210 is/are obscured or hidden from view. This provides a second surprise element for the user, since even after removing packaging 100 the user (e.g., the child) may be unable to ascertain which character they have obtained (e.g., purchased).

Although the depicted embodiments illustrate figurine 200 as a human figurine, the figurine presented herein need not be a figurine. For example, in other embodiments, the figurine might be an animal, mythical character, humanoid, alien, etc. Regardless of its form, the figurine 200 will be entirely covered with the dissolvable layer 250 that hides an overall appearance of the figurine 200 (e.g., by hiding facial features, complexion, color, and/or other identifying features) until the dissolvable layer 250 is removed from the figurine 200. Moreover, although "entirely covering" may involve covering the figurine in a first position P1, the position P1 need not be a standing position like the illustrated position P1 and may be any position (e.g., a sitting position, walking position (human or animal), etc.).

Still further, to be clear, the term "entirely covered" does not require that the overall shape of a toy be hidden. Instead, a toy can be coated or sprayed in a manner that entirely covers the toy figurine 200 without hiding its shape and/or features (e.g., without hiding that the figurine 200 is a human figurine). Thus, the terms "coated," "coating," "coat(s)", and the like, are used herein to denote that the shape and/or features of a covered toy (e.g., figurine 200) are not hidden when a toy is entirely covered. For example, the depicted toy figurine 200 is entirely covered with a thin conformal film that coats the underlying body 210. Thus, the arms, legs, and overall structure of the toy figurine 200 are discernable when the dissolvable layer 250 is on the toy figurine 200, but the overall appearance (e.g., the identity) is hidden.

Figure 5:
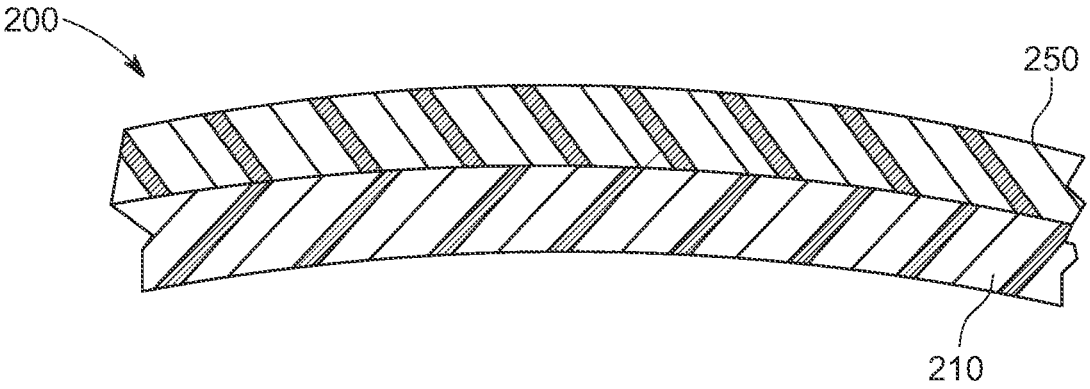
FIG. 5 is a sectional view of a portion of the toy figurine of FIG. 3 that illustrates the dissolvable layer and an underlying body of the toy figurine.

FIG. 5 depicts a sectional view of a portion of figurine 200 that depicts the dissolvable layer 250 entirely covering a portion of the underlying body 210 of figurine 200. Generally, the underlying body 210 may be formed from a plastic material that is painted, dyed, or otherwise colored with waterproof materials. For example, the underlying body 210, or at least a portion thereof, may be formed from colored plastic that holds its color when exposed to water. This type of plastic may define the complexion 212 of the underlying body 210. Additionally or alternatively, the underlying body 210, or at least a portion thereof, may be formed from thermochromic materials that change color in response to hot or cold energy, as is disclosed in U.S. Pat. No. 5,503,583, which is issued to Hippely et al. and which is entitled TOY WITH THERMOCHROMIC MATERIAL, the entirety of which is hereby incorporated by reference.

Figure 10:
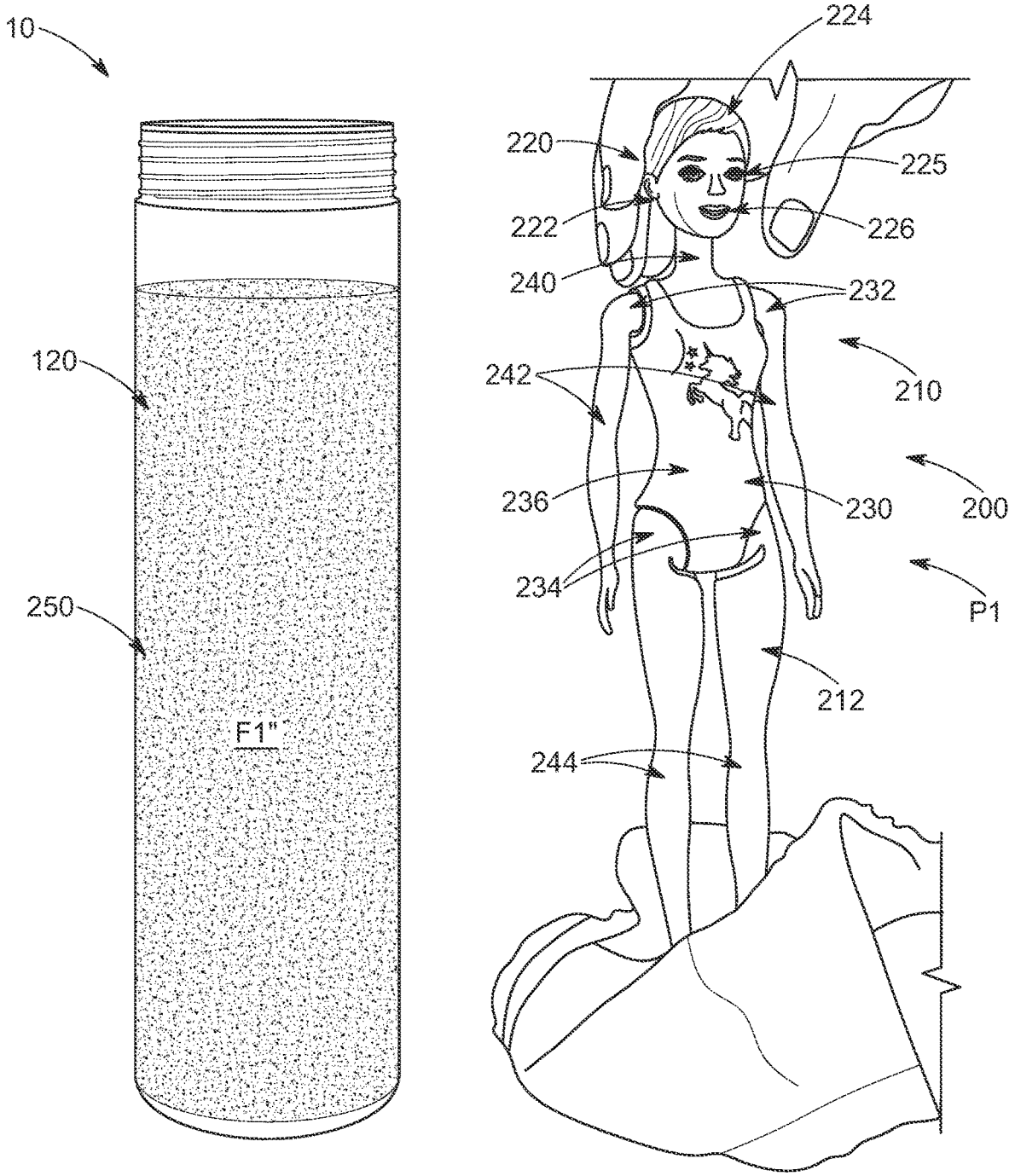
FIG. 10 is a front view of the portion of the packaging of FIG. 6 and toy figurine of FIG. 3 after the toy figurine has been removed from the fluid.

For example, the legs 244, arms 242, neck 240, and a portion of head 220 may be formed from a plastic of a first color and/or painted/dyed with a waterproof material of the first color so that these portions of figurine 200 define a complexion 212 of figurine 200 (see FIG. 10). Meanwhile, the torso 230 may be formed from a plastic of a second color and/or painted/dyed with a waterproof material of at least a second color so that the torso 230 defines clothing 236 (e.g., a onesie, unitard, shirt, and/or tank top) on the underlying body 210 of the figurine 200 (see FIG. 10). Still further, facial features 222 on the head 220 may be formed from thermochromic material so that the facial features 222 on the underlying body 210 can change color when exposed to hot or cold energy (e.g., hot or cold water), as is explained in further detail in connection with FIGS. 12, 13A, and 13B.

In contrast with the underlying body 210, the dissolvable layer 250 is formed from a material that dissolves when immersed in a fluid, such as water. For example, the dissolvable layer 250 may be a water dissolvable layer of paint that can be applied to the underlying body 210 (e.g., via any combination of spraying, brushing, dipping, etc.) to form a thin, conformal film thereover. Unlike traditional paints, the dissolvable layer of paint may lack a cross-linker or curing agent so that the paint is easily dissolvable. For example, according to some embodiments, the dissolvable layer 250 may be a paint composed of approximately 40-60% water, approximately 15-22% organic solvent (e.g., ethanol), approximately 10-20% pigment/colorant, approximately 10-20% water soluble resin, approximately 0-3% film forming agent, approximately 0.5-3% dispersing agent, approximately 0-3% humectant, and approximately 0-2% matting agent (e.g., silica)

In at least some embodiments, the dissolvable material that is used to form the dissolvable layer 250 is configured to decouple from the underlying body 210 upon exposure to a fluid (e.g., fluid F1) and mix into the fluid to color the fluid. This may cause the fluid to become opaque, thereby hiding the underlying body 210 from view during a "transformation." This may create a third surprise element for the toy set 10 (e.g., since the user must remove the figurine 200 from a fluid F1 to see the underlying body 210). In at least some embodiments, the figurine 200 can simply be dunked into a fluid F1 to remove the dissolvable layer 250 from the underlying body 210 but, in other embodiments, the figurine 200 and/or the fluid F1 may need to be agitated (e.g., by spinning the figurine 200, sealing and shaking the vessel 120, etc.) to remove the dissolvable layer 250 from the underlying body 210.

Figure 6:
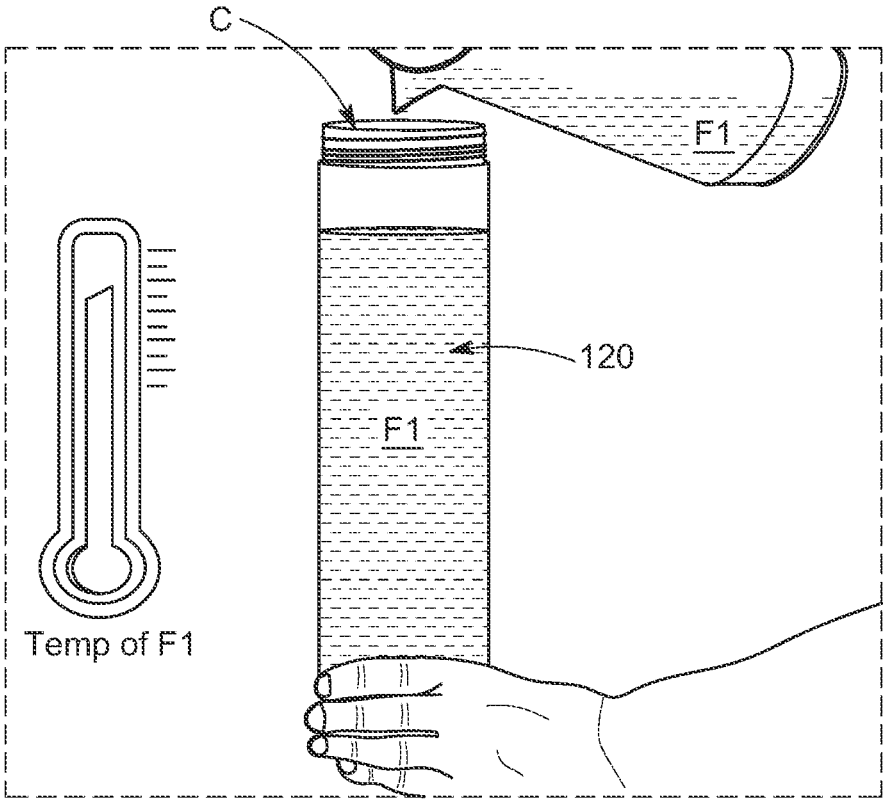
FIG. 6 is a front view of a portion of the packaging of FIG. 1 while being filled with a fluid.
Figure 7:
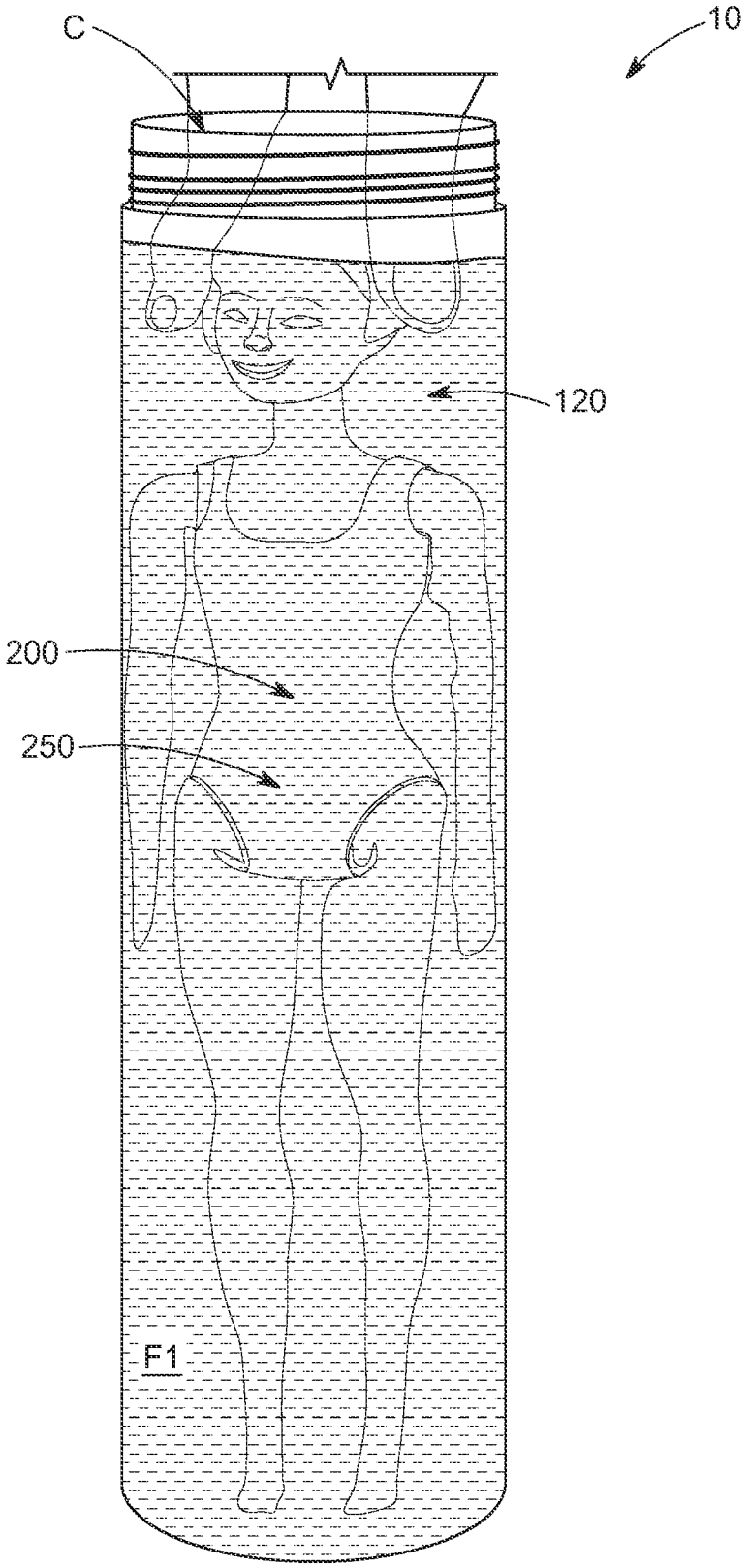
FIGS. 7-9 are front views of the portion of the packaging of FIG. 6 that illustrate the toy figurine of FIG. 3 being submerged into the fluid.
Figure 8:
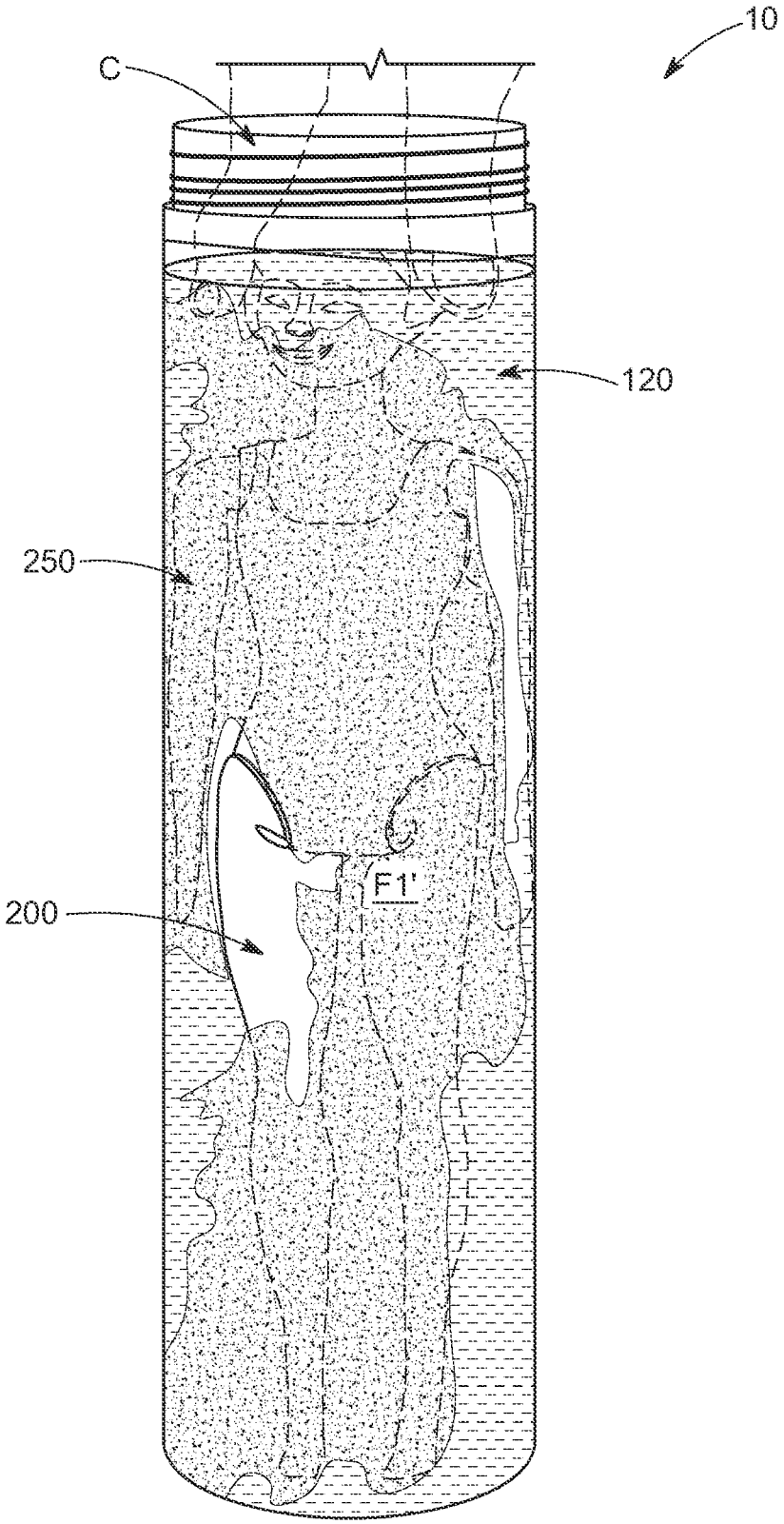
Figure 9:
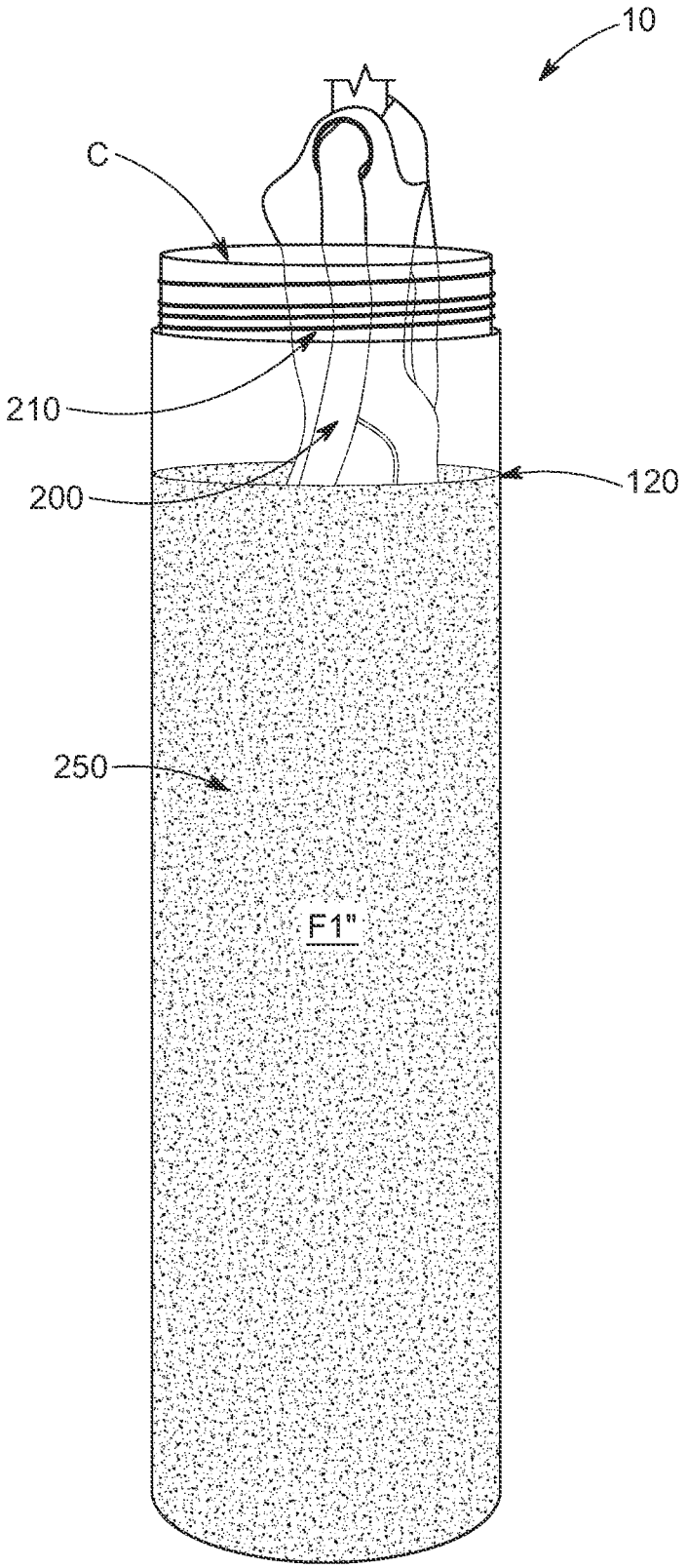

Now turning to FIGS. 6-10, these figures illustrate an example transformation of the figurine 200 according to an example embodiment. That is, FIGS. 6-10 illustrate an example removal of the dissolvable layer 250 from the underlying body 210. Initially, as shown in FIG. 6, the compartment C of the vessel 120 is filled with a warm fluid F1. Then, as shown in FIG. 7, the figurine 200 is submerged or immersed (e.g., dunked) into the fluid F1 disposed in compartment C. As is shown in FIGS. 8 and 9, after a few seconds of immersion, the dissolvable layer 250 begins to dissolve (and detach from the underlying body 210) and begins to cloud the fluid F1 so that it becomes cloudy fluid F1', until eventually the fluid F1 becomes an opaque fluid F1".

In at least some embodiments, the fixed volume of the compartment C is specifically sized to ensure that the compartment C contains enough fluid F1 to completely remove the dissolvable layer 250 while also ensuring that the dissolvable layer 250 can render the fluid F1 opaque. That is, the compartment C may be sized to allow the figurine 200 to be completely submerged into the fluid F1 and/or may be sized based on the amount of material (e.g., paint) included in the dissolvable layer 250. For example, in the depicted embodiment, the compartment C is taller than the figurine 200 and includes a diameter that is wider than the figurine to allow the figurine 200 to be completely submerged in the compartment C. However, the compartment C is only slightly bigger than the figurine to achieve an adequate ratio of fluid F1 to the amount of material included in the dissolvable layer 250. In some embodiments, the ratio of fluid to dissolvable material may be in the range of approximately 0.7 Liters of fluid per gram of dissolvable material (e.g., paint) to approximately 1 Liter of fluid per gram of dissolvable material. For example, if the dissolvable layer 250 is formed with approximately 2 grams of dissolvable paint, the compartment C may be sized to receive approximately 1.7 liters of fluid F1.

When the fluid is an opaque fluid F1", this provides an indication that a transformation is complete and, thus, the figurine 200 can be removed from the compartment C to reveal the underlying body 210 and the overall appearance of the figurine 200, as is shown in FIG. 10. That is, as mentioned, once the dissolvable layer 250 is removed (as shown in FIG. 10), facial features 222, such as hair 224, eyes 225, and lips 226 may be visible to the user (e.g., a child). Additionally or alternatively, the skin complexion 212 of the figurine 200 and/or clothing 236 included on the torso 230 of the underlying body 210 may be visible to the user (e.g., a child).

Figure 11A:
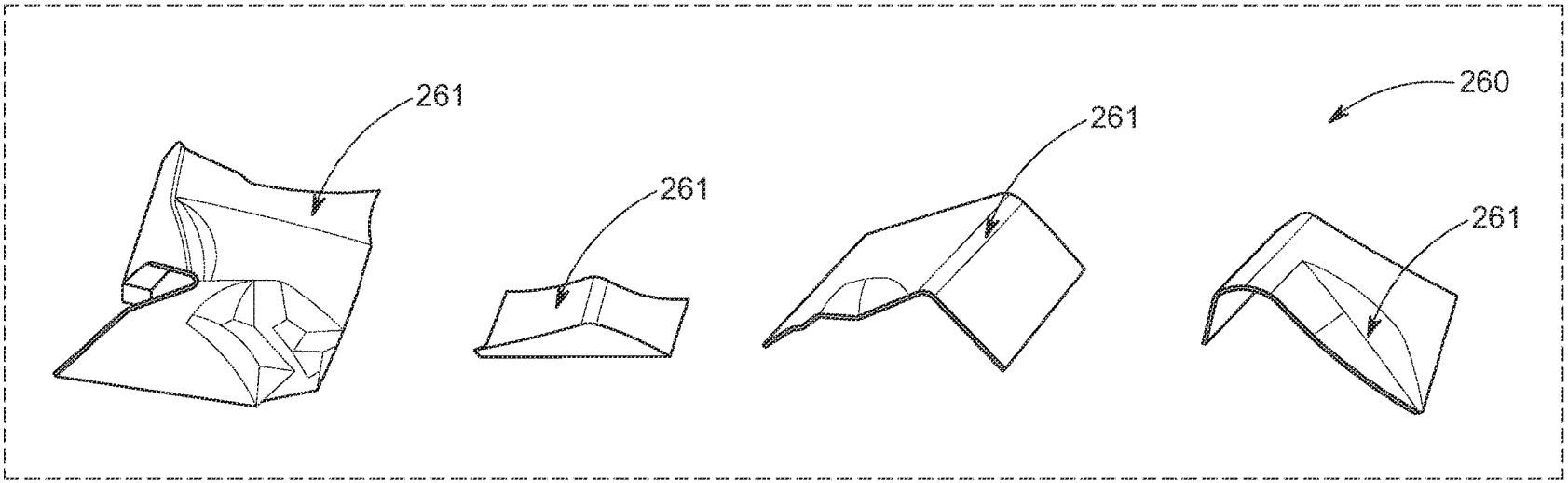
FIGS. 11A and 11B illustrate accessories that may be included in the toy set of FIG. 1, prior to and subsequent to being removed from their accessory packaging.
Figure 11B:
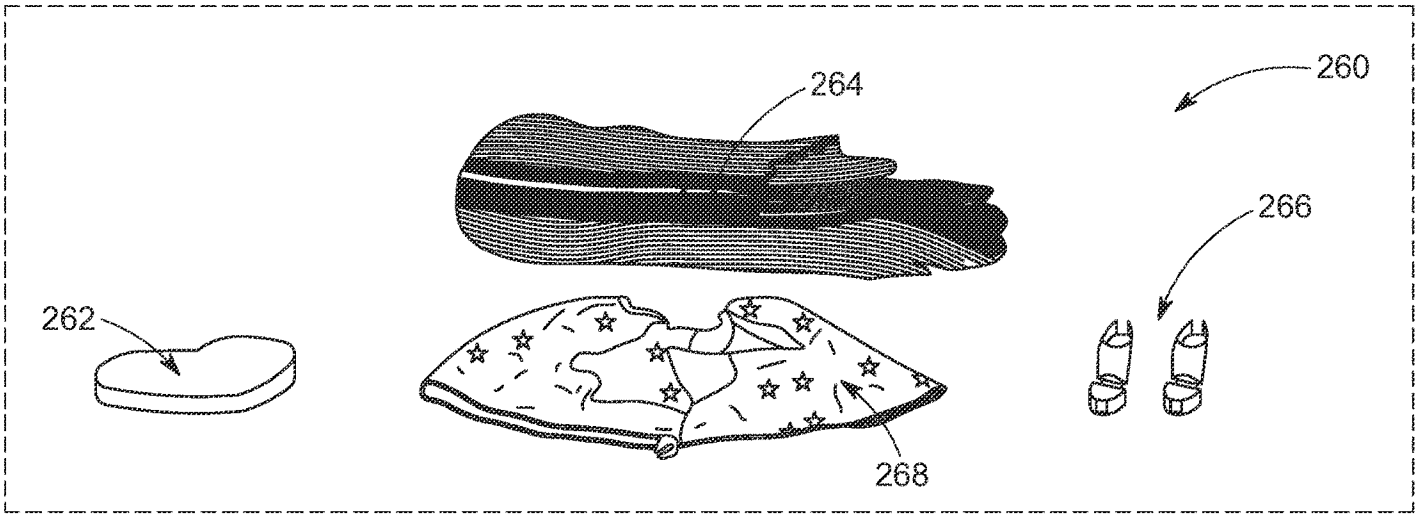

Now turning to FIGS. 11A and 11B, as mentioned, the toy set 10 may include accessories 260. In the depicted embodiment, each of the accessories 260 is packaged within individual packaging 261 that may be stored within the compartment C (e.g., on, below, above, and/or around the figurine 200). Packaging the accessories 260 may help to hide the identity of the figurine 200 and may provide yet additional elements of surprise within the toy set 10. In the depicted embodiment, the accessories 260 include a water retaining element 262 (e.g., a cloth or sponge), a wig 264, a skirt 268, and shoes 266; however, in other embodiments, the play set may include any other accessories (e.g., of any type, style, shape, color, etc.) instead of or in addition to wig 264, skirt 268, and shoes 266. In at least some embodiments, the wig 264, skirt 268, and shoes 266 included in a particular toy set 10 may complement or coordinate with the overall appearance of the figurine 200 (e.g., facial features 222, clothing 236, and/or complexion 212 of the underlying body 210) that is initially hidden by dissolvable layer 250.

Figure 12:
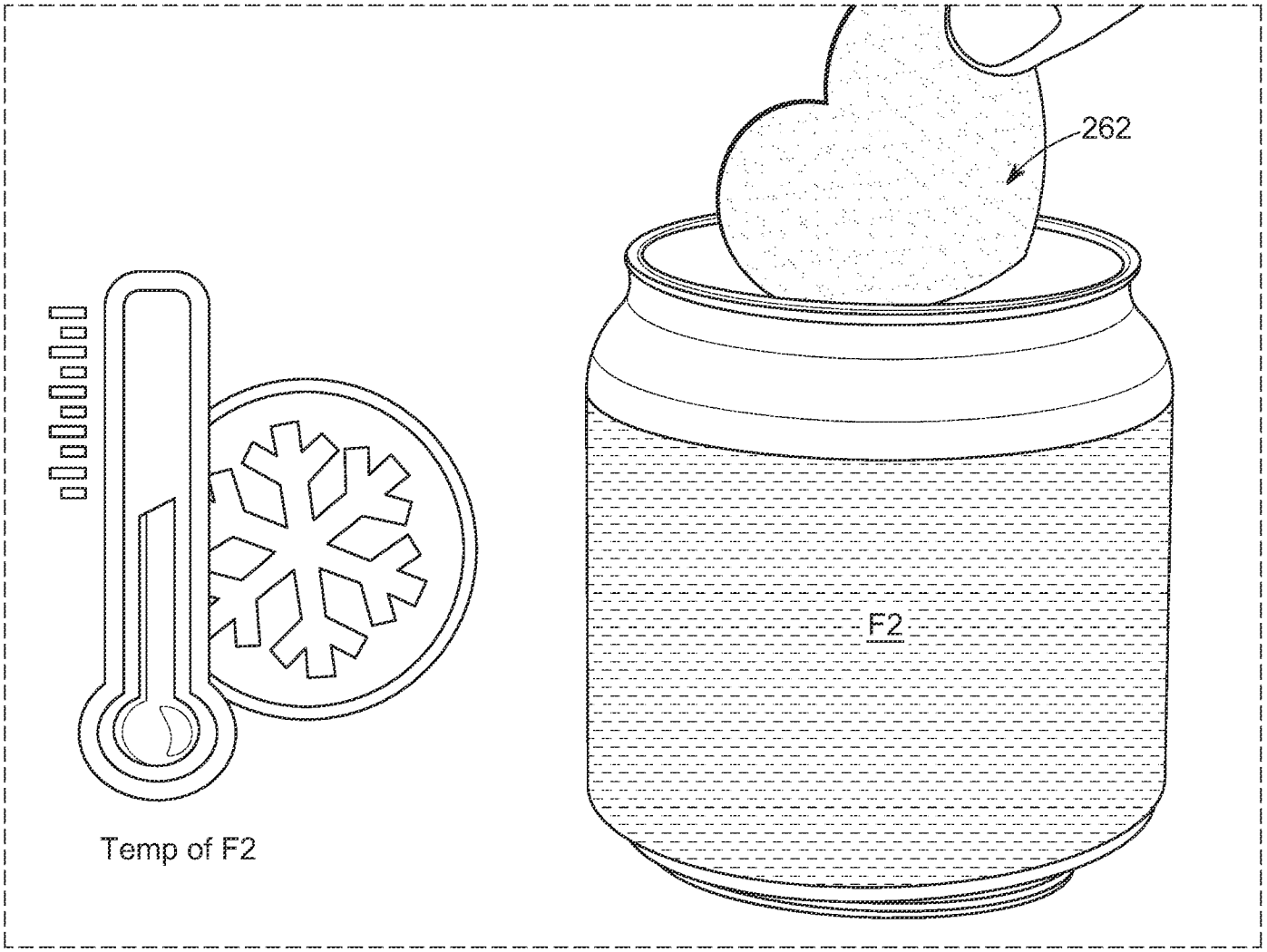
FIGS. 12, 13A, and 13B illustrate interplay between one of the accessories illustrated in FIG. 11B and thermochromic features included in or on the underlying body of the toy figurine.
Figure 13B:
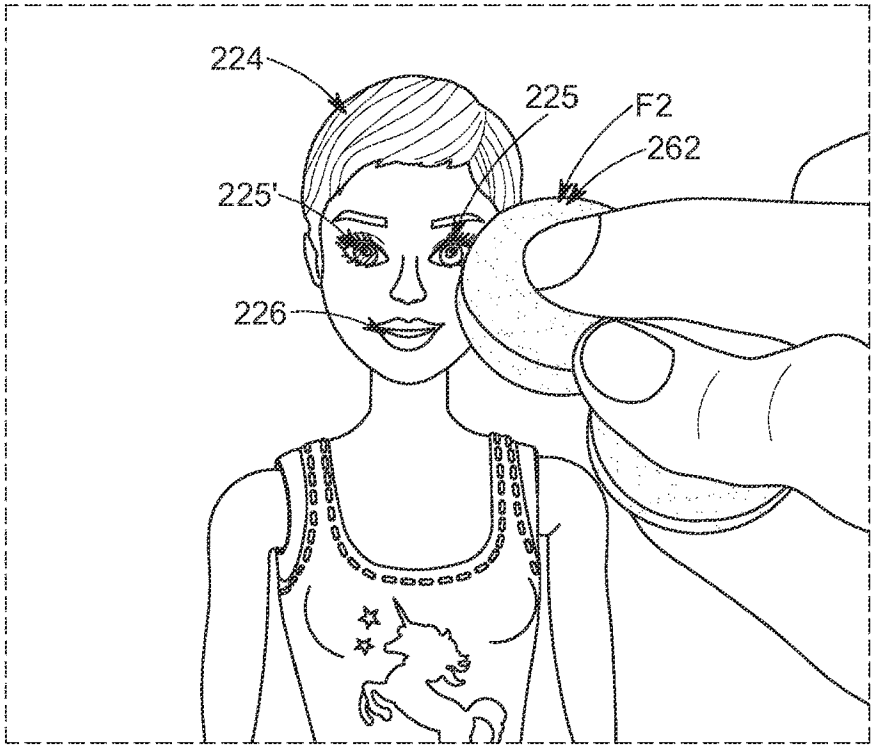
Figure 13A:
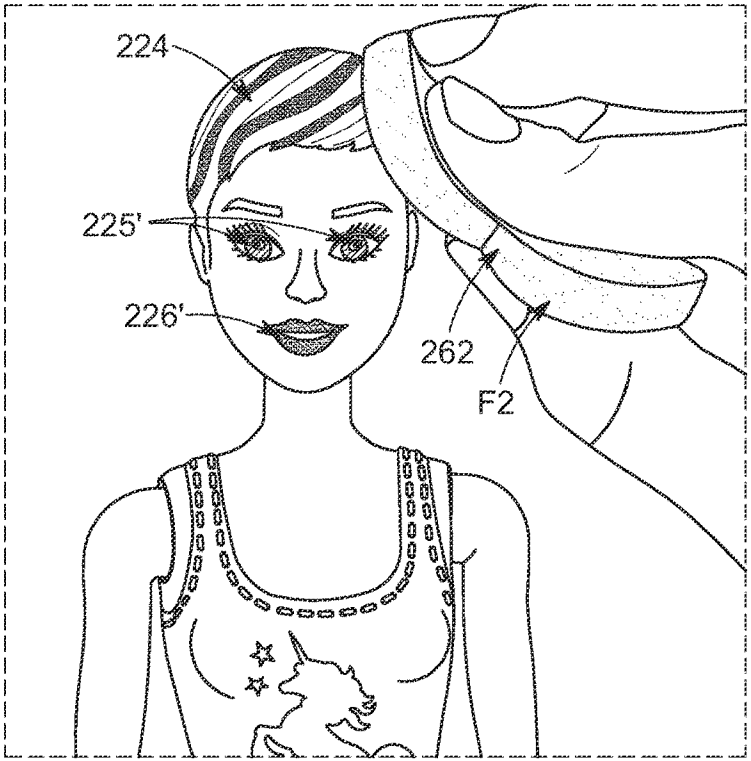

Now turning to FIGS. 12, 13A, and 13B, the water retaining element 262 may allow a user to activate thermochromic features included on the underlying body 210. As is explained in U.S. Pat. No. 5,503,583, which as mentioned above is incorporated herein by reference, thermochromic features may be activated or deactivated with cold or hot energy (e.g., hot or cold water). Thus, in the depicted embodiment, the water retaining element 262 may be dipped in cold fluid F2 (as shown in FIG. 12) and rubbed on the hair 224 (as shown in FIG. 13A), the eyes 225 (shown in FIG. 13B), and/or the lips 226 (not shown) of the head 220 of the figurine 200. As shown in FIGS. 13A and 13B, when the eyes 225 have been rubbed with cold water, the eyes 225 may change color, to the color shown at 225' (e.g., from gray to blue). Similarly, when the lips 226 have been rubbed with cold water, the lips 226 may change color, to the color shown at 226' (e.g., from tan to red). Finally, when the hair 224 have been rubbed with cold water, the hair 224 may reveal streaks (e.g., from all pink to pink with blue streaks).

Figure 14:
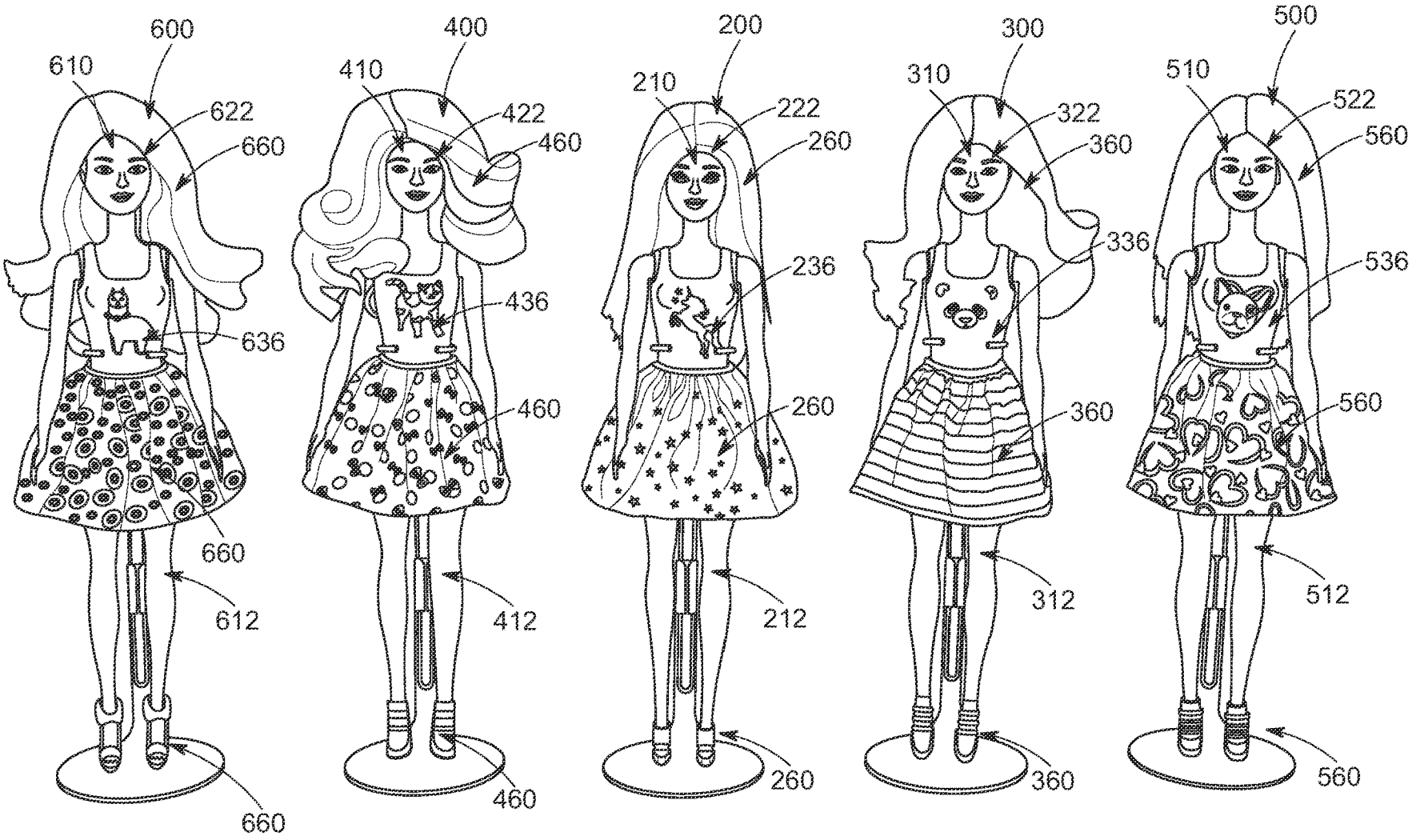
FIG. 14 illustrates five example underlying bodies that may be hidden under a dissolvable layer with corresponding accessories secured thereto.

FIG. 14 illustrates an example set of characters that may be coated with a dissolvable layer 250 with accessories mounted thereon. The figurine 200 is shown in the center of FIG. 14 with its accessories 260 mounted thereon. By comparison, figurine 300 includes a second set of facial features 322, a second skin complexion 312, a second item of clothing 336, and a second set of accessories 360 that complement its clothing 336 and the overall appearance of the underlying body 310 of figurine 300. Next, figurine 400 includes a third set of facial features 422, a third skin complexion 412, a third item of clothing 436, and a third set of accessories 460 that complement its clothing 436 and the overall appearance of the underlying body 410 of figurine 400. Still further, figurine 500 includes a fourth set of facial features 522, a fourth skin complexion 512, a fourth item of clothing 536, and a fourth set of accessories 560 that complement its clothing 536 and the overall appearance of the underlying body 510 of figurine 500. Finally, figurine 600 includes a fifth set of facial features 622, a fifth skin complexion 612, a fifth item of clothing 636, and a fifth set of accessories 660 that complement its clothing 636 and the overall appearance of the underlying body 610 of figurine 600.

Notably, the overall dimensions of figurines 200, 300, 400, 500, and 600 are similar, if not identical. Thus, since the dissolvable layer 250 hides the facial features, skin complexion, and clothing of a figurine, a user will not be able to determine which of figurine 200, 300, 400, 500, and 600 he or she has purchased until the dissolvable layer 250 is removed from the underlying body which it is coating. Consequently, as discussed above, the dissolvable layer 250 will provide at least one element of surprise for a user.

Now turning to FIGS. 15-20, these figures illustrate an example embodiment of packaging that may include a dissolvable layer formed thereon. As mentioned above, in at least some embodiments, packaging may include a dissolvable layer to hide or conceal a toy figurine disposed therein and/or to create an interesting and surprising reveal of the toy figurine disposed therein. In the depicted embodiment, toy set 70 includes packaging 700 with the dissolvable layer 250 formed on an internal wall 726 of a vessel 720.

More specifically, in the depicted embodiment, the packaging 700 includes a vessel 720 that is similar to vessel 120 and that supports opaque packaging 710 that is similar to outer packaging 110. Thus, for brevity, like parts of these components are only discussed briefly below and it is to be understood that any description of parts or features of toy set 10 included above is applicable to like parts or features of toy set 70. For example, opaque packaging 710 extends from a top 714 to a bottom 716 and may cover any portion of vessel 720, like outer packaging 110 may cover any portion of entire vessel 120. As another example, although dissolvable layer 250 is now included on or in packaging 700, it is to be understood that dissolvable layer 250 may be the same composition, material, etc. as, and may be applied in the same manner as, the dissolvable layer 250 applied to figurine 200. For example, interior wall 726 may be dipped in or sprayed with a dissolvable paint to create a dissolvable layer 250 thereon.

That said, in the depicted embodiment, vessel 720 includes a sidewall 722 that extends between a bottom 724 and an open top 728 (see FIG. 19) to form an annular container. The interior wall 726 extends across this annular container, between two portions of sidewall 722 to divide the container into a first compartment C1 and a second compartment C2, as shown clearly in FIG. 20. That is, a first side 7261 (or surface 7621) of interior wall 726 cooperates with sidewall 722 (as well as the bottom 724 and open top 728) to define a first compartment C1 and a second side 7262 (or surface 7262) of interior wall 726, which is opposite first side 7261, cooperates with sidewall 722 (as well as the bottom 724 and open top 728) to define a second compartment C2. In the depicted embodiment, the first compartment C1 receives a figurine 75 (see FIG. 20) and, thus, may also be referred to as the figurine compartment C1. Meanwhile, the second compartment C2 is configured to receive a fluid to initiate a dissolving action of the dissolvable layer 250 and, thus may also be referred to as the action or fluid compartment C2.

In this particular embodiment, the interior wall 726 extends straight across a central portion of vessel 720 to define two hemispherical compartments C1 and C2 that are about equal in size. However, in other embodiments, interior wall 726 may be any shape and size, and may extend across vessel 720 in any manner (e.g., along a curved path). Still further, in some embodiments, the interior wall 726 need not extends across vessel 720 and, for example, could be concentric with sidewall 722. Put another way, the sidewall 722 might be hollow and the vessel 720 might not include an interior wall 720.

Figure 15:
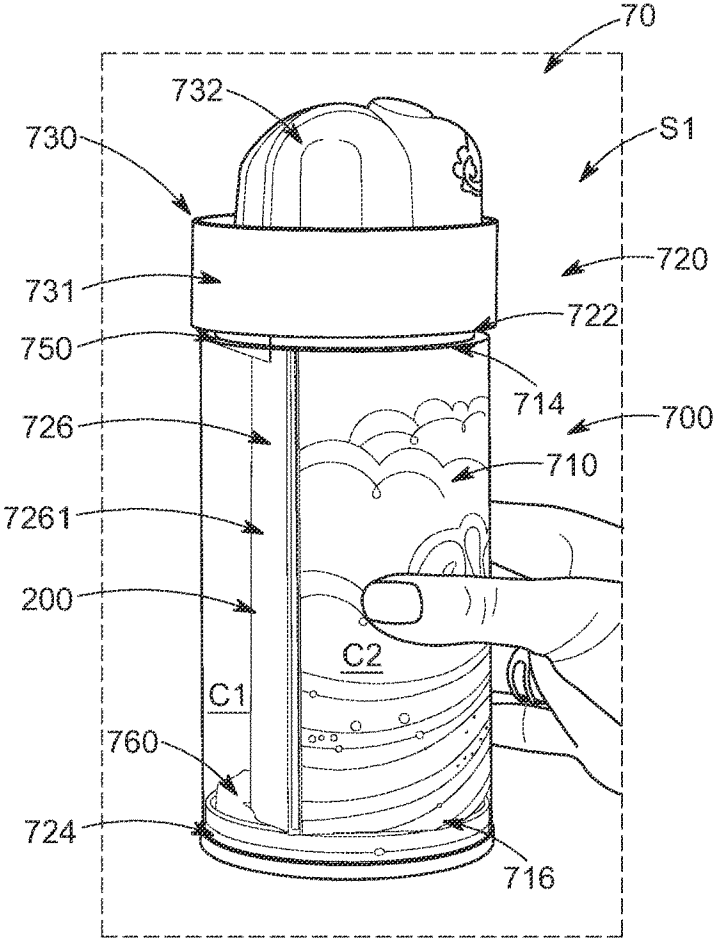
FIG. 15 illustrates a side view of an example embodiment of a toy set including an example embodiment of the toy figurine packaging with a dissolvable layer presented herein.

As can be seen in FIG. 15, in the depicted embodiment, the sidewall 722 is substantially transparent, but the opaque packaging 710 and the dissolvable layer 250 on the interior wall 726 substantially conceal the figurine compartment C1. Thus, a user (e.g., a child) cannot see a figurine 75 disposed in the figurine compartment C1 when the packaging 700 is in its non-actuated state S1. In the depicted embodiment, the opaque packaging 710 extends approximately halfway around sidewall 722 to enclose the figurine compartment C1; however, in other embodiments, the figurine compartment C1 could be any size and may be enclosed or hidden in any manner. For example, the sidewall 722 could be partially opaque, include a dissolvable layer 250 formed thereon, or some combination thereof. As a specific example, in some embodiments, the sidewall 722 might be hollow (e.g., define an internal chamber) so that the first compartment C1 is defined interiorly of the sidewall 722, the second compartment C2 is defined within the sidewall 722, and a dissolvable layer 250 might coat at least a portion of the hollow sidewall 722 (e.g., an interior side).

Since the sidewall 722 is transparent, the sidewall 722 allows a view of the action compartment C2 which may be entertaining for a user who is opening packaging 700. In particular, the transparent sidewall 722 provides a view of the first side 7261 of interior wall 726, which is coated with the dissolvable layer 250. By comparison, the second side 7262 of interior wall 726 may be transparent and uncoated. Thus, when the dissolvable layer 250 is dissolved, a user may be able to see a figurine 75 stored in figurine compartment C1 through the interior wall 726, as is shown to varying degrees in FIGS. 17-19.

Figure 16A:
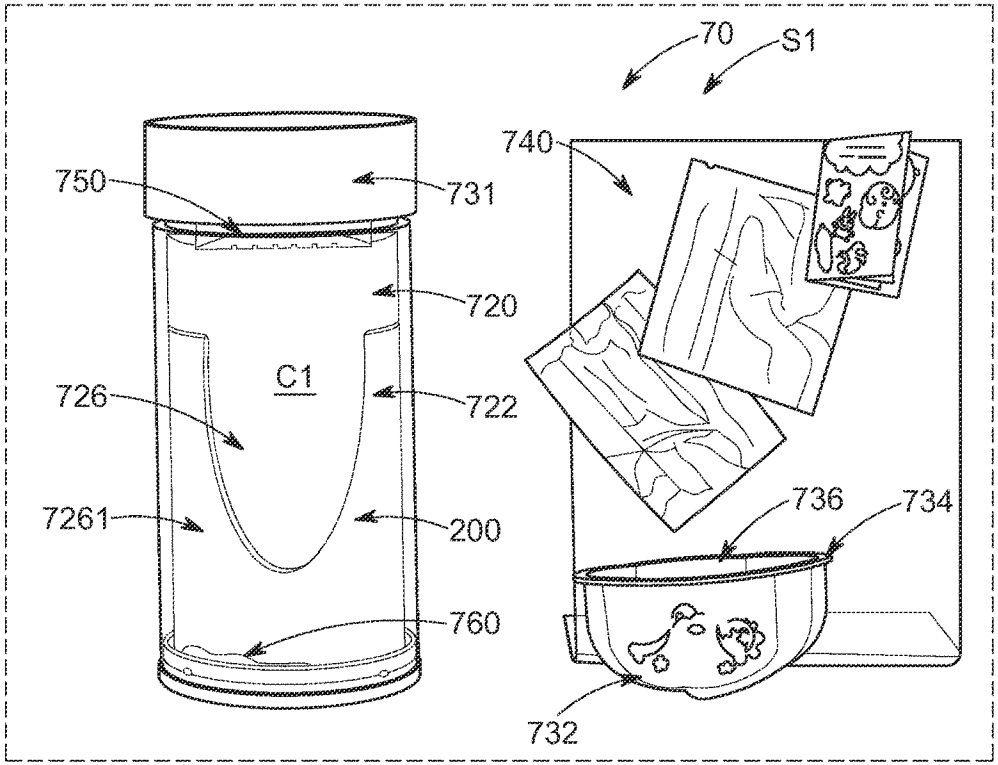
FIG. 16A illustrates a back perspective view of the toy figurine packaging of FIG. 15, the toy figurine packaging being partially disassembled.
Figure 16B:
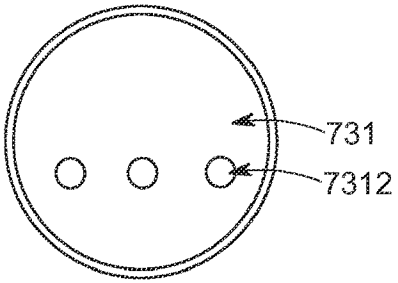
FIG. 16B illustrates a top view of a base of a lid of the toy figurine packaging of FIG. 15.

As can be seen in FIGS. 15, 16A, and 16B, in the depicted embodiment, the vessel 720 is topped or capped by a lid 730. In this particular embodiment, the lid 730 is a two-part lid and includes a base 731 and a removable top 732. The removable top 732 defines a receptacle 736 and includes a rim 734 that can removably engage the base 731. The receptacle 736 can store accessories 740 when the packaging 700 is in the non-actuated state S1 (e.g., a packaging state) and can hold a fluid F1 when a user wants to fill the action compartment C2 with a fluid. That is, the receptacle 736 allows the removable top 732 to act as pitcher, bucket, or other such container. The base 731 is secured to the vessel 720 via a lid removal mechanism 750 and includes fluid pathways 7312 that extend through the base 731, from a top of base 731 to the action compartment C2 (see FIG. 16B). However, in other embodiments, the lid 730 may be a one-piece lid, have more than two pieces, may not act as a container for fluid, and/or may include any other desirable features, provided that the lid 730 can: (a) be releasably attached to the vessel 720; and (b) funnel or guide fluid into action compartment C2.

Moreover, in the depicted embodiment, the removable top 732 may be detached from the base 731 at any time (e.g., before or after a transformation of packaging 700), but the base 731 may be detached from the vessel 720 only after a fluid has been introduced into the action compartment C2. This is because a lid removal mechanism 750 secures the base 731 to a top 728 of the vessel 720 until a fluid is introduced into the action compartment C2 via fluid pathways 7312 included in the base 731 of the lid 730, as is described in further detail below.

Figure 18:
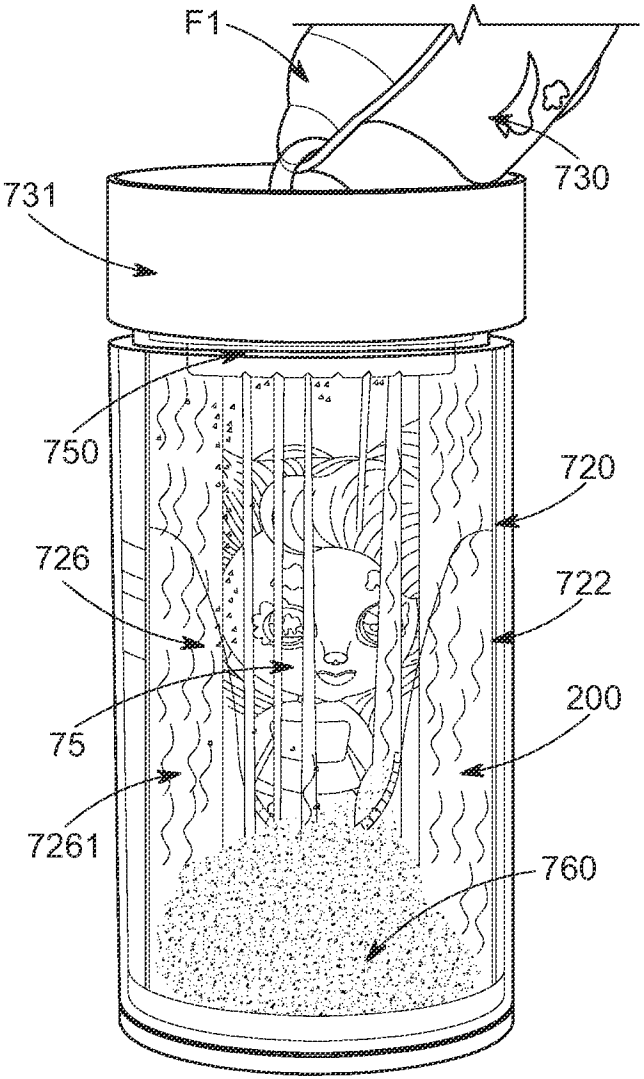
FIGS. 17-19 are back perspective views of the portion of the toy figurine packaging of FIG. 15 that illustrate fluid being introduced into the toy figurine packaging.
Figure 17:
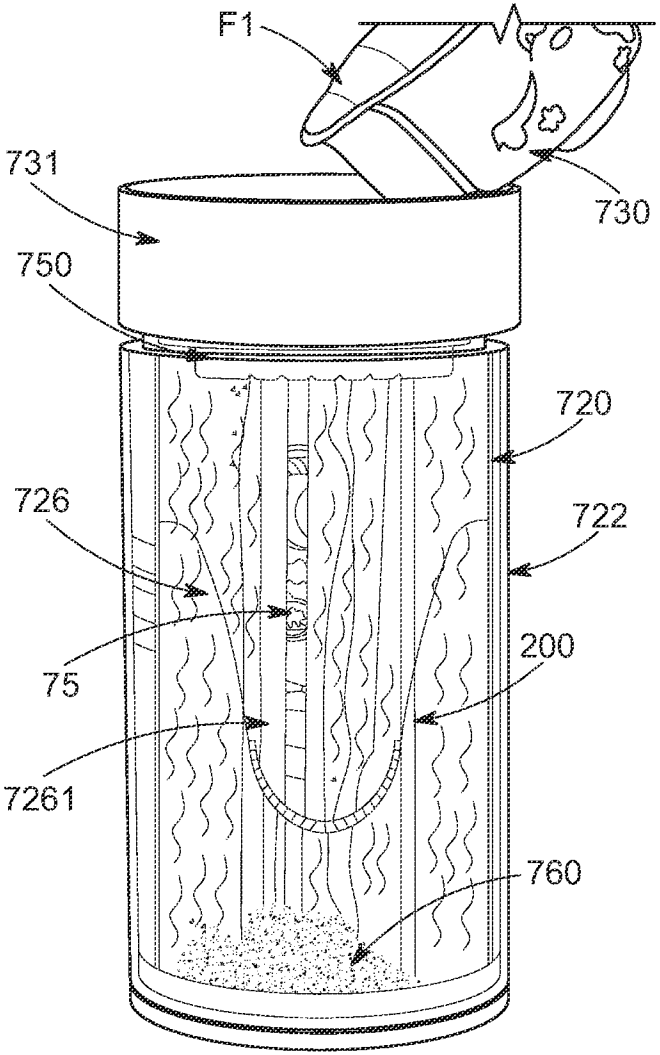
Figure 19:
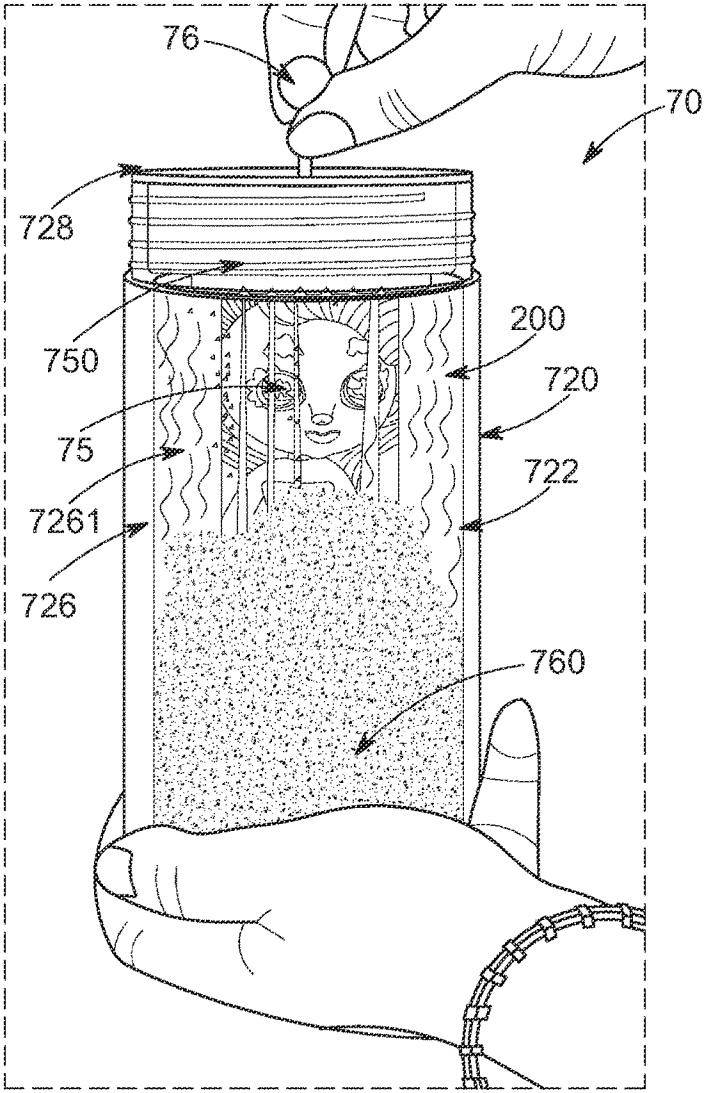

FIGS. 17-19 illustrate the packaging 700 during a transformation. In this particular embodiment, a fluid F1 (e.g., a warm fluid) is poured into the base 731 of lid 730 to initiate a transformation. However, in other embodiments, it is conceivable that the transformation may be caused with fluid F1 in any other manner. For example, the entire packaging 700 might be dunked or immersed in fluid F1 if the dissolvable layer 250 is included on an outer surface of sidewall 722. Regardless, during a transformation, fluid F1 dissolves or at least begins to dissolve the dissolvable layer 250 so that the figurine 75 can be at least partially seen from an exterior of the packaging 700. In some embodiments, the figurine 75 and the packaging 700 may both include a dissolvable layer 250 and, thus, exposing the packaging 700 to fluid F1 may provide a view of the figurine 75 without revealing the identity of the toy figurine 75. However, in the depicted embodiment, figurine 75 is uncoated and, thus, dissolving the dissolvable layer 250 may provide a view of the figurine 75, at least for a moment.

More specifically, to initiate a transformation, fluid F1 is poured into the base 731 of the lid 730. The fluid pathways 7312 in the base 731 guide the fluid F1 towards the action compartment C2 and, more specifically, towards the first side 7261 of the interior wall 726. As the fluid F1 flows over the first side 7261 of the interior wall 726, the dissolvable layer 250 begins to dissolve as shown in FIGS. 17-19, revealing more and more of the figurine 75 in an interesting and surprising manner.

In at least some embodiments, the fluid pathways 7312 may be or include funnels or funnel-type elements to guide the water into the interior wall 726. Additionally or alternatively, although not shown, the fluid pathways 7312 may be angled, swirled, or otherwise non-linear. Non-linear fluid pathways 7312 may allow a fluid to move through the base 731 and into contact with a dissolvable layer 250 included on the interior wall 726, but will also prevent a user from seeing into the vessel 720. That said, in other embodiments, the fluid pathways 7312 need not be non-linear since the fluid pathways 7312 lead into the action compartment C2 and the figurine 75 is enclosed within figurine compartment C1, which may be surrounded or enclosed by opaque elements when the packaging 700 is in the non-actuated state S1 (so that the figurine 75 is, for the most part, not visible from outside of the figurine compartment C1).

Additionally, in the depicted embodiment, absorbent pellets 760 are included in the action compartment C2 when the packaging is in its non-actuated state S1 (e.g., resting at the bottom of the action compartment C2). Thus, as the fluid F1 flows towards the bottom of the action compartment C2, the fluid F1 may be absorbed by the absorbent pellets 760. Since the absorbent pellets 760 expand upon absorbing fluid, the absorbent pellets 760 may begin to rise from the bottom of the action compartment C2, creating another surprising and entertaining element during a transformation of packaging 700. That is, the absorbent pellets 760 may appear to grow within the action compartment C2.

The absorbent pellets 760 may also be opaque and, thus, as the absorbent pellets 760 rise or grow, the absorbent pellets 760 may obscure the view of the figurine 75 that the dissolving dissolvable layer 250 is beginning to provide (due to fluid F1 dissolving the dissolvable layer 250). That is, in the depicted embodiment, the view of the figurine 75 is only provided for a moment because the absorbent pellets 760 cover the transparent interior wall 726 as the dissolvable layer 250 dissolves. This may create further entertainment for the user and/or extend the surprise of the figurine reveal. Moreover, as can be seen in FIG. 20, once the base 731 of lid 730 has been removed from the vessel 720, the absorbent pellets 760 can be poured out of the vessel 720 and used for explorative play with the figurine 75.

Figure 20:
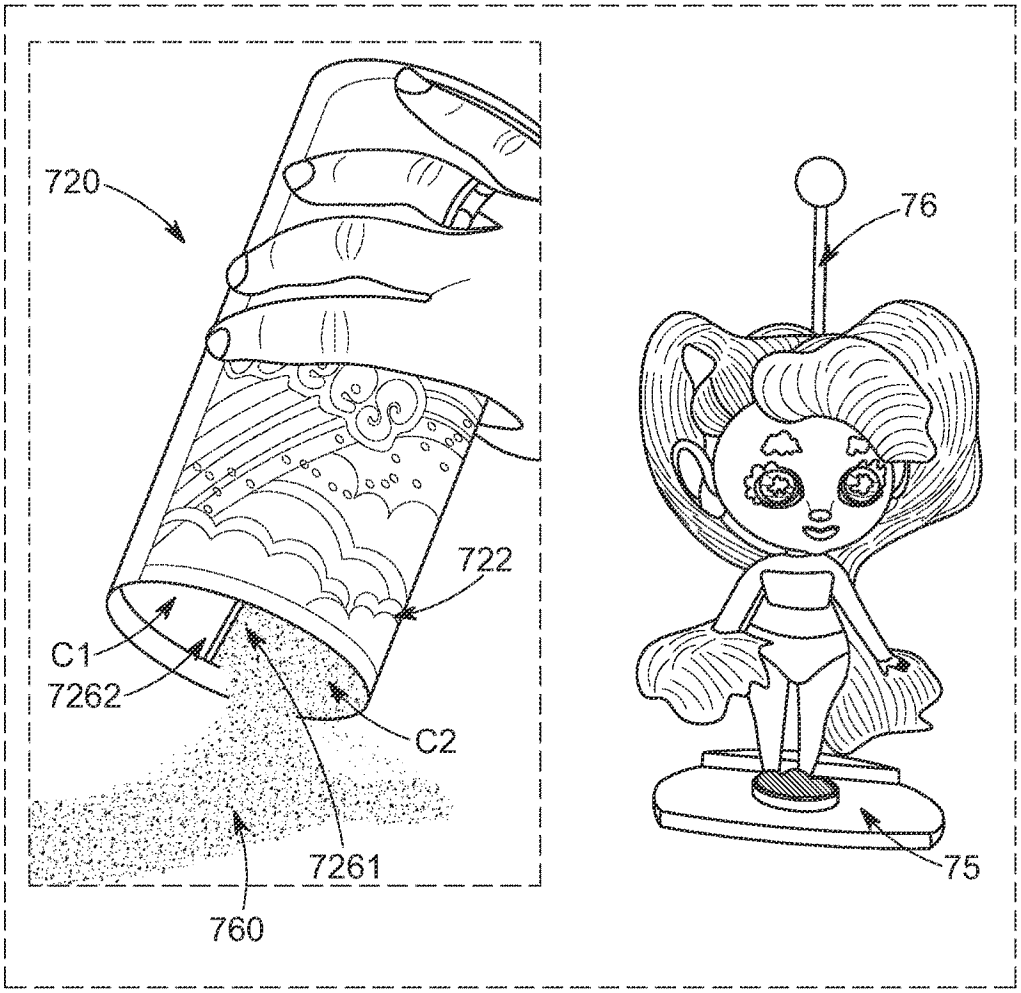
FIG. 20 illustrates a toy figurine while removed from the toy figurine packaging of FIG. 15, the toy figurine packaging being shown subsequent to a fluid being introduced into the toy figurine packaging.

Now referring to FIGS. 19 and 20, in the depicted embodiment, the base 731 of lid 730 is secured to the vessel 720 with a lid removal mechanism 750 when the packaging 700 is in the non-actuated state S1. As fluid F1 is introduced into the action compartment C2, the fluid F1 may unlock or loosen the lid removal mechanism 750 to allow the base 731 to be removed from the vessel 720. However, other embodiments need not include a lid removal mechanism 750 and the lid 730 or portions thereof may be removably attached to the vessel 720 in any manner. Additionally, in other embodiments, the lid 730 need not guide a fluid F1 therethrough and the packaging or dissolvable layer 250 may hide the figurine 75 in the figurine compartment C1 during introduction of fluid into the action compartment C2 in any manner. For example, underneath the lid 730, the figurine compartment C1 might be covered with discardable packaging while the action compartment C2 is uncovered.

That said, in the depicted embodiment, the base 731 is substantially solid and opaque, aside from the fluid pathways 7312. Thus, when base 731 is attached to vessel 720, compartments C1 and C2 may be substantially closed (or enclosed). However, the base 731 is the only element covering compartments C1 and C2 and, thus, when base 731 is detached or removed from vessel 720, compartments C1 and C2 are open-top compartments. That is, when base 731 is removed from the vessel 720, compartments C1 and C2 may be visible from above the vessel 720. Thus, once base 731 is removed from vessel 720, the figurine 75 may be removable from the figurine compartment C1. Additionally, if the packaging 700 includes absorbent pellets 760, the absorbent pellets 760 may be removable from the action compartment C2 when the lid 730 is removed from vessel 720. In the depicted embodiment, the figurine 75 includes a handle 76 to assist with removal of the figurine from the figurine compartment C1.

Figure 22:
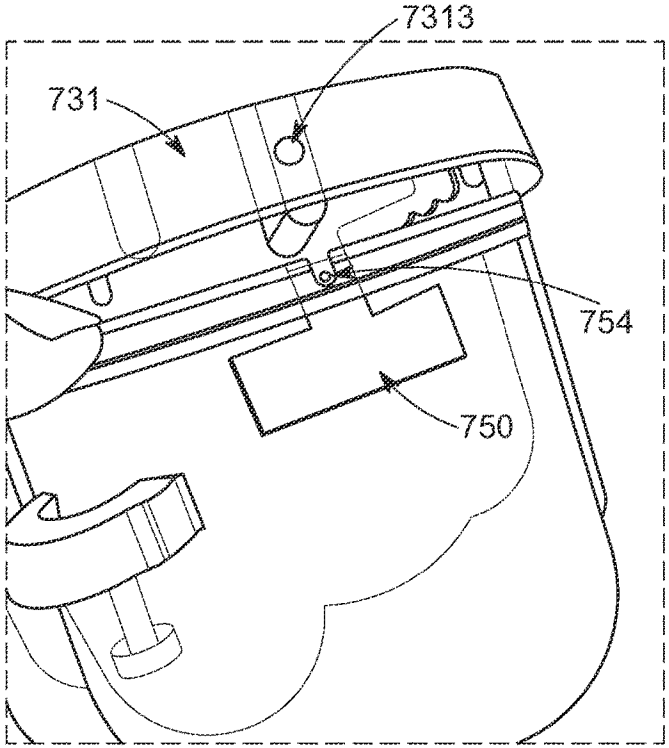
FIGS. 21 and 22 illustrate perspective views of a lid included in the toy figurine packaging of FIG. 15.
Figure 21:
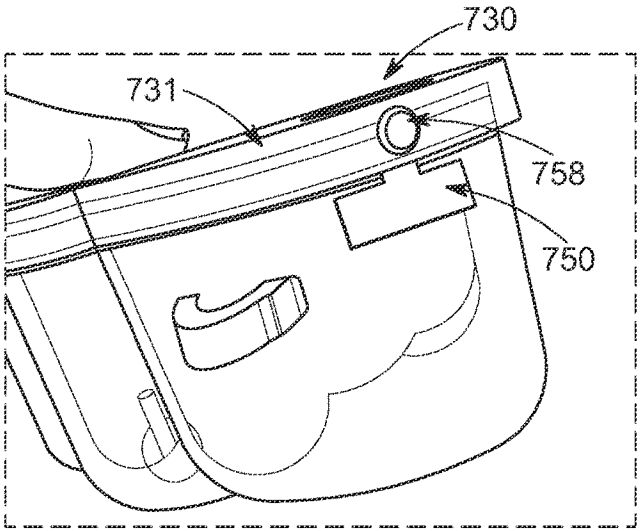
Figure 23:
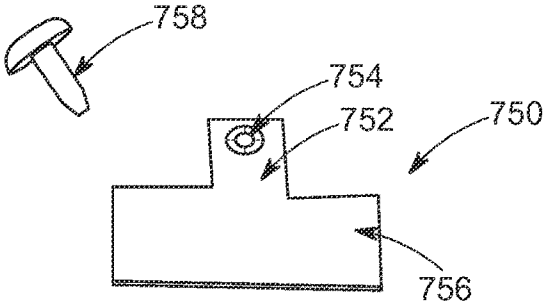
FIG. 23 illustrates a perspective view of a lid removal mechanism included in the toy figurine packaging of FIG. 15.

Now turning to FIGS. 21-23, in the depicted embodiment, the lid removal mechanism 750 is a paper-based element that weakens or disintegrates when exposed to fluid F1. For example, the lid removal mechanism 750 may be a water-dissolvable cardboard/chip board member. More specifically, the lid removal mechanism 750 may be a T-shaped, paper or paper-based element with a tongue portion 752 and a lock portion 756. The tongue portion 752 includes an aperture 754 that aligns with an aperture (not shown) included on the base 731 of the lid 730 when the lid removal mechanism 750 is installed on the lid 730 (e.g., when the packaging 700 is in its non-actuated state S1). Thus, when the packaging 700 is in its non-actuated state S1, a fastener 758 can extend through both the aperture 754 and the aperture included on the base 731 to lock the base 731 to the vessel 720. In some embodiments, the vessel 720 may also include an aperture that aligns with the apertures of the base 731 and the lid removal mechanism 750 and the fastener 758 may extend through all three apertures.

When the fastener 758 is installed through the apertures in the base 731 and the lid removal mechanism 750 (and the base 731 is installed on the vessel 720), the lock portion 756 of the lid removal mechanism 750 can prevent upwards movement of the lid removal mechanism 750, which, in turn, prevents upwards movement of the base 731 of the lid 730 (since fastener 758 is secured through both apertures). Additionally or alternatively, if the fastener 758 extends through apertures in the vessel 720, the lid 730, and the lid removal mechanism 750, the fastener 758 may prevent upwards movement of the lid 730. In any case, the lid removal mechanism 750 is positioned inwards of the base 731 and the vessel 720, within the action chamber C2. Thus, when fluid F1 is poured into the action chamber C2, the fluid F1 comes into contact (e.g., runs over) the lid removal mechanism 750.

When the lid removal mechanism 750 is exposed to fluid F1, the paper or paper-based lid removal mechanism 750 loses structural integrity (e.g., it softens and/or weakens). At this point, upwards movement of the base 731 can cause the fastener 758 to rip or otherwise move through the tongue portion 752, disconnecting the base 731 from the lid removal mechanism 750 and the vessel 720. Alternatively, the softened/weakened lid removal mechanism 750 can be pulled away from the vessel 720 (e.g., with the lid 730) to release the lid 730 from the vessel 720. Regardless, the lid removal mechanism 750 locks the lid 730, or at least a portion thereof, to the vessel 720 until a fluid F1 loosens or unlocks the lid removal mechanism 750. Thus, the lid removal mechanism 750 may be referred to as a fluid- or water-activated unlatching mechanism.

While the toy figurine and packaging presented herein has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. That is, it is believed that the disclosure set forth above encompasses multiple distinct inventions with independent utility. While each of these inventions has been disclosed in a preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Accordingly, it is appropriate that the appended claims be construed broadly and in a manner consistent with the scope of the disclosure as set forth in the following claims.

It is also to be understood that the toy figurine and packaging described herein, or portions thereof may be fabricated from any suitable material or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Additionally, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Finally, when used herein, the term "comprises" and its derivations (such as "comprising", etc.) should not be understood in an excluding sense, that is, these terms should not be interpreted as excluding the possibility that what is described and defined may include further elements, steps, etc. Similarly, where any description recites "a" or "a first" element or the equivalent thereof, such disclosure should be understood to include incorporation of one or more such elements, neither requiring nor excluding two or more such elements. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially".

What is claimed is:

1. A toy play set comprising:

a toy figurine;

a vessel within which the toy figurine is packaged, the vessel defining a sealable compartment that, when sealed, defines a fixed volume; and a dissolvable layer disposed on the toy figurine, at least a portion of the vessel, or both, to obscure an overall appearance of the toy figurine, wherein the fixed volume of the sealable compartment is sized to receive an amount of fluid sufficient to fully dissolve the dissolvable layer and, once dissolved, the dissolvable layer renders the amount of fluid opaque, and wherein the vessel is at least partially transparent so that, when the dissolvable layer is dissolved and opaque fluid is removed, the overall appearance of the toy figurine is visible through the vessel.

2. The toy play set of claim 1, wherein the sealable compartment is a fluid compartment and the vessel comprises an interior wall that defines the fluid compartment and a figurine compartment sized to receive the toy figurine, and wherein the dissolvable layer is disposed on a surface of the interior wall defining the fluid compartment.

3. The toy play set of claim 2, wherein the interior wall extends across the vessel.

4. The toy play set of claim 2, wherein, aside from the interior wall, the figurine compartment is at least partially formed from or covered by opaque materials so that, aside from the interior wall, the figurine compartment is substantially opaque.

5. The toy play set of claim 2, further comprising:

opaque absorbent pellets disposed in the fluid compartment, wherein the opaque absorbent pellets expand upon absorbing the fluid so that the opaque absorbent pellets increasingly obscure the toy figurine as the dissolvable layer reveals the overall appearance of the toy figurine.

6. The toy play set of claim 1, further comprising:

opaque outer packaging that, when disposed on the vessel, substantially covers the vessel to hide the toy figurine positioned therein from view;

accessories that match the overall appearance of the toy figurine, the accessories being packaged in obscure packaging so that the obscure packaging and the dissolvable layer collectively to hide an identity of the toy figurine; or both the opaque outer packaging and the accessories.

7. A toy play set, comprising:

a toy figurine;

a vessel within which the toy figurine is packaged;

a dissolvable layer disposed on the toy figurine, at least a portion of the vessel, or both, to obscure an overall appearance of the toy figurine, wherein the dissolvable layer is dissolvable in a fluid and the vessel is at least partially transparent so that, when the dissolvable layer is dissolved, the overall appearance of the toy figurine is visible through the vessel; and opaque outer packaging that, when disposed on the vessel, substantially covers the vessel to hide the toy figurine positioned therein from view; accessories that match the overall appearance of the toy figurine, the accessories being packaged in obscure packaging so that the obscure packaging and the dissolvable layer collectively hide an identity of the toy figurine; or both the opaque outer packaging and the accessories.

8. The toy play set of claim 7, wherein the overall appearance of the toy figurine includes a skin complexion and facial features of the toy figurine, such that obscuring the overall appearance hides the identity of the toy figurine.

9. The toy play set of claim 7, wherein the identity is selected from a set of identities associated with figurines of like dimensions and the facial features include hair color, eye color, and lip color.

10. The toy play set of claim 7, wherein the toy figurine comprises a human figurine including a head that is movably mounted on a neck, arms that are movably mounted to a torso, and legs that are movably mounted to the torso.

11. The toy play set of claim 7, wherein the vessel defines a sealable compartment that, when sealed, defines a fixed volume sized to receive an amount of the fluid sufficient to fully dissolve the dissolvable layer.

12. The toy play set of claim 11, wherein the fixed volume is sized so that, once dissolved, the dissolvable layer renders the amount of fluid opaque.

13. The toy play set of claim 7, wherein the vessel comprises an interior wall that defines a fluid compartment and a figurine compartment sized to receive the toy figurine, and wherein the dissolvable layer is disposed on a surface of the interior wall defining the fluid compartment.

14. The toy play set of claim 13, wherein the interior wall extends across the vessel.

15. The toy play set of claim 13, wherein, aside from the interior wall, the figurine compartment is at least partially formed from or covered by opaque materials so that, aside from the interior wall, the figurine compartment is substantially opaque.

16. The toy play set of claim 13, further comprising:

opaque absorbent pellets disposed in the fluid compartment, wherein the opaque absorbent pellets expand upon absorbing the fluid so that the opaque absorbent pellets increasingly obscure the toy figurine as the dissolvable layer reveals the overall appearance of the toy figurine.

17. A toy play set, comprising:

a toy;

a vessel within which the toy is packaged;

a dissolvable layer disposed on the toy, at least a portion of the vessel, or both, to obscure an overall appearance of the toy, wherein the dissolvable layer is dissolvable in a fluid to reveal the overall appearance of the toy;

a lid that defines fluid pathways into the vessel; and a fluid-activated lid removal mechanism that fixedly couples the lid to the vessel until the fluid is introduced to the vessel.

18. The toy play set of claim 17, wherein the fluid-activated lid removal mechanism is a paper-based mechanism that loses structural integrity when exposed to the fluid.

19. The toy play set of claim 17, wherein the fluid pathways are non-linear fluid pathways.

20. The toy play set of claim 17, wherein the lid comprises:

a base that is secured to the vessel via the fluid-activated lid removal mechanism; and a removable top that is removably coupled to the base, both prior to and subsequent to an introduction of the fluid into the vessel.

* * * * *